US007992868B2

(12) United States Patent
Tachibana et al.

(10) Patent No.: US 7,992,868 B2
(45) Date of Patent: Aug. 9, 2011

(54) IMAGE FORMING APPARATUS CAPABLE OF DETECTING EDGE PORTION OF SHEET BEING FED

(75) Inventors: Yuta Tachibana, Toyokawa (JP); Yoshiyuki Toso, Toyokawa (JP); Yutaka Otsuka, Toyokawa (JP); Shoichi Tsuge, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 55 days.

(21) Appl. No.: 12/633,462

(22) Filed: Dec. 8, 2009

(65) Prior Publication Data

US 2010/0140864 A1 Jun. 10, 2010

(30) Foreign Application Priority Data

Dec. 8, 2008 (JP) ..... 2008-312164

(51) Int. Cl.
*B65H 7/02* (2006.01)

(52) U.S. Cl. ..... 271/265.02; 271/265.01; 271/270

(58) Field of Classification Search ..... 271/265.02, 271/265.01, 270, 227
See application file for complete search history.

(56) References Cited

U.S. PATENT DOCUMENTS

| | | | | |
|---|---|---|---|---|
| 6,554,275 | B1 * | 4/2003 | Tranquilla | 271/259 |
| 6,788,322 | B2 | 9/2004 | Morita | |
| 2005/0185229 | A1 | 8/2005 | Sano et al. | |
| 2009/0072475 | A1 * | 3/2009 | Sawada | 271/265.02 |

FOREIGN PATENT DOCUMENTS

| | | |
|---|---|---|
| JP | 6-183605 | 7/1994 |
| JP | 7-236033 | 9/1995 |
| JP | 2003-223088 | 8/2003 |
| JP | 2003-248410 | 9/2003 |
| JP | 2004-284793 | 10/2004 |
| JP | 2005-12783 | 1/2005 |
| JP | 2007-314273 | 12/2007 |

OTHER PUBLICATIONS

Japanese Decision to Grant Patent mailed Nov. 2, 2011, directed to counterpart Japanese Application No. 2008-312164; 6 pages.

* cited by examiner

*Primary Examiner* — Stefanos Karmis
*Assistant Examiner* — Luis A Gonzalez
(74) *Attorney, Agent, or Firm* — Morrison & Foerster LLP

(57) ABSTRACT

A sheet detection unit of an image forming apparatus includes a light receiving unit including a plurality of light receiving elements arranged in a sheet feeding direction. A computation processing unit shifts signals from the elements in synchronization with a sheet feeding speed and makes additions, increases a signal change level, and stores the signals in buffers in a result storage unit. A sheet position determination unit detects a position of an edge portion of a sheet being fed based on distribution of data stored in the buffers.

12 Claims, 19 Drawing Sheets

IMAGE FORMING APPARATUS CAPABLE OF DETECTING EDGE PORTION OF SHEET BEING FED

This application is based on Japanese Patent Application No. 2008-312164 filed with the Japan Patent Office on Dec. 8, 2008, the entire content of which is hereby incorporated by reference.

BACKGROUND OF THE INVENTION

1. Field of the Invention

The present invention relates to an image forming apparatus and a detection method in the image forming apparatus, and in particular, to an image forming apparatus detecting an edge portion of a sheet being fed inside the image forming apparatus and a detection method thereof.

2. Description of the Related Art

In an image forming apparatus, it is necessary to accurately detect an edge portion of a sheet being fed in order to set a position for starting writing of image data on the sheet to a defined position.

Conventionally, a technique of detecting an edge portion of a sheet being fed utilizing an actuator as shown in FIG. 18 has been proposed. Further, optical detection means (an optical sensor) utilizing differences in reflectance and transmittance of light depending on presence or absence of a sheet as shown in FIGS. 19A and 19B has also been used. Furthermore, Japanese Laid-Open Patent Publication No. 2003-223088 discloses a technique of providing positional displacement detection means in a direction perpendicular to a feeding direction, and correcting a position for starting writing of an image according to the calculated amount of displacement in a main scanning direction. Japanese Laid-Open Patent Publication No. 2003-248410 discloses a technique of detecting a leading edge of a sheet by a reading mechanism having reading elements arranged in a feeding direction, and determining time to start image formation. Japanese Laid-Open Patent Publication No. 2005-012783 discloses a technique of detecting positional displacement of a sheet according to a change in the amount of light utilizing a light receiving element having a light receiving surface with a prescribed length in a feeding direction and a light emitting element, in which either one of the elements is configured to be movable in the feeding direction and thus can detect positional displacements of sheets in plural sizes.

However, none of these techniques can detect a sheet edge unless a trailing edge of a preceding sheet and a leading edge of a subsequent sheet are apart from each other for a prescribed distance, that is, unless there is a sheet interval, during feeding. Therefore, when the sheet interval is less than the prescribed distance or when a preceding sheet overlaps with a subsequent sheet, there occurs a problem that the sheet edge cannot be accurately detected even by using these techniques.

SUMMARY OF THE INVENTION

The present invention has been made in view of such a problem, and one object of the present invention is to provide an image forming apparatus capable of detecting an edge portion of a sheet being fed even when a sheet interval is narrow or a preceding sheet overlaps with a subsequent sheet, and a detection method thereof.

To accomplish the object described above, according to an aspect of the present invention, an image forming apparatus includes: a feeding mechanism for feeding a sheet on a feeding path at a prescribed feeding speed; one or more light emitting sources for emitting light onto the feeding path; a plurality of light receiving elements arranged on a side opposite to a side on which the light emitting source is provided, with the feeding path being interposed therebetween, linearly at a defined interval from an upstream side to a downstream side in a feeding direction in the feeding mechanism, and respectively outputting signals according to amounts of received light; an information storage device including buffers respectively corresponding to the plurality of light receiving elements, and a buffer other than those; and a computation device. The computation device is for (i) performing computation on a plurality of data obtained from the signals respectively from the plurality of light receiving elements at a defined computation cycle, and obtaining computation results respectively corresponding to the plurality of data, (ii) storing the computation results in the buffers according to the corresponding light receiving elements, in the information storage device, and (iii) detecting a position of an edge portion of the sheet being fed on the feeding path based on a characteristic of a data series formed of the entire computation results by arranging the respective stored computation results according to an arrangement of the corresponding light receiving elements. Further, the computation is processing that shifts previous computation results respectively stored in the buffers to the buffers corresponding to the light receiving elements adjacent to the corresponding light receiving elements in the feeding direction in the arrangement, adds or subtracts the shifted computation results to or from the data obtained from the signals from the light receiving elements corresponding to the buffers receiving the shifted computation results, and thereby obtains new computation results, at each computation cycle.

To accomplish the object described above, according to another aspect of the present invention, a method for detecting an edge portion of a sheet being fed on a feeding path in an image forming apparatus is provided, and the method includes the steps of providing an image forming apparatus including a feeding mechanism for feeding a sheet on a feeding path at a prescribed feeding speed, one or more light emitting sources for emitting light onto the feeding path, a plurality of light receiving elements arranged on a side opposite to a side on which the light emitting source is provided, with the feeding path being interposed therebetween, linearly at a defined interval from an upstream side to a downstream side in a feeding direction in the feeding mechanism, and respectively outputting signals according to amounts of received light, and an information storage device including buffers respectively corresponding to the plurality of light receiving elements, and a buffer other than those; performing computation of adding or subtracting, to or from a plurality of data obtained from the signals respectively from the plurality of light receiving elements, previous computation results respectively stored in the buffers corresponding to the light receiving elements adjacent to the corresponding light receiving elements in the feeding direction in an arrangement, and obtaining computation results respectively corresponding to the plurality of data, at each defined computation cycle; storing the computation results in the buffers according to the corresponding light receiving elements; and detecting a position of the edge portion of the sheet being fed on the feeding path based on a characteristic of a data series formed of the entire computation results by arranging the respective stored computation results according to the arrangement of the corresponding light receiving elements.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
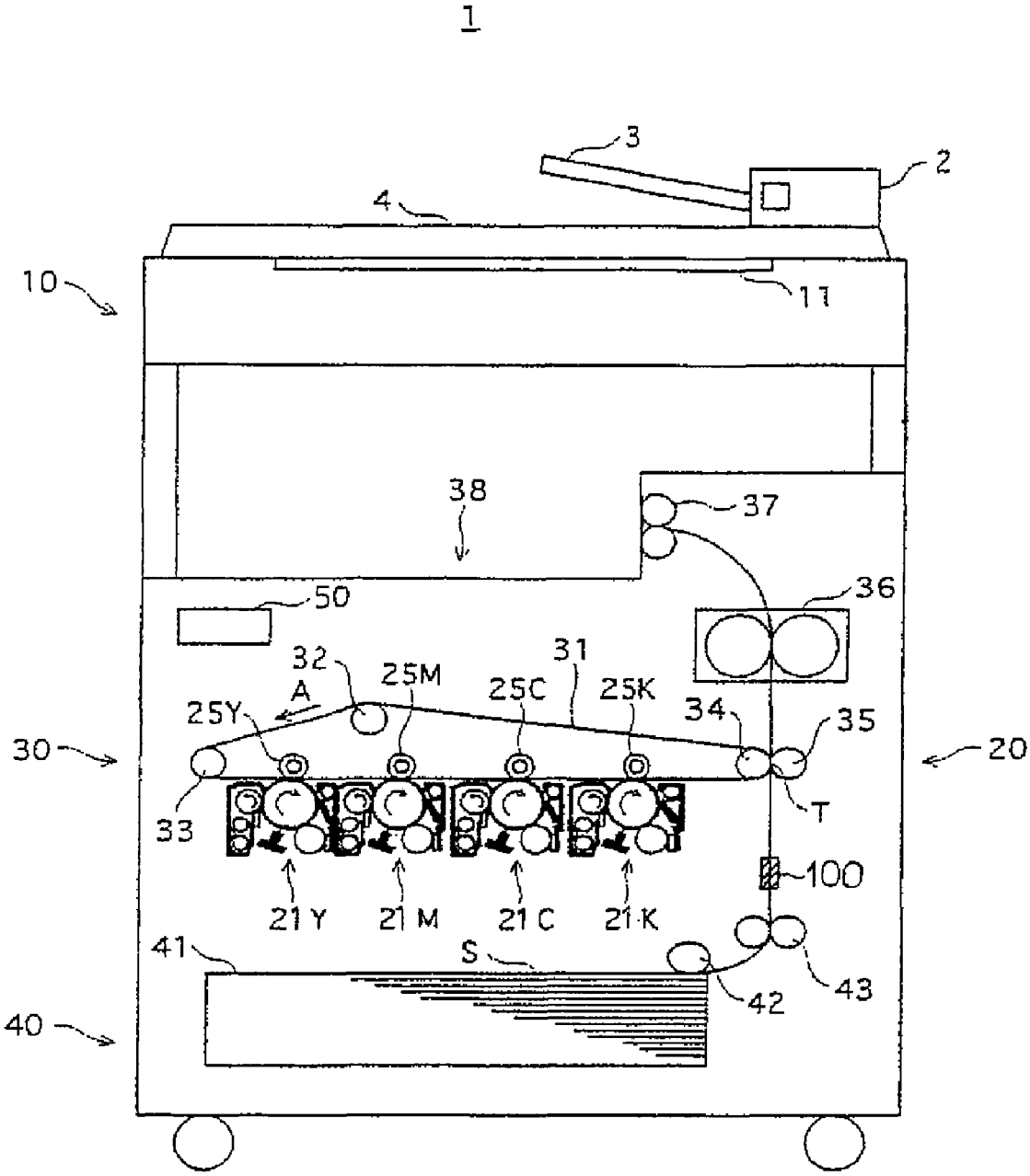
FIG. 1 is a schematic view showing a concrete example of a configuration of an image forming apparatus in accordance with embodiments.

Hereinafter, embodiments of the present invention will be described with reference to the drawings. In the description given below, identical parts and components will be designated by the same reference numerals, and have identical names and functions.

First Embodiment

An image forming apparatus 1 in accordance with the present embodiment is assumed as a tandem-system digital color copying machine. However, the image forming apparatus is not limited to a copying machine, and may be a printer, a facsimile apparatus, an MFP (Multi Function Peripheral) combining these apparatuses, or the like. Further, the printing system is not limited to the tandem system, and not limited to the digital system. Furthermore, the image forming apparatus may be a monochrome machine instead of a color machine.

A color tandem-system image forming apparatus is configured such that four color imaging units each including a developer are arranged in a row along an intermediate transfer belt serving as an intermediate transfer body. Toner images of the respective colors formed respectively are transferred onto the intermediate transfer belt (primary transfer), and a multicolor image is formed by superimposing toners of the respective colors. Further, the image superimposed on the intermediate transfer belt is transferred onto a sheet serving as a printing medium (secondary transfer), and subjected to a fixing process and then output.

Image forming apparatus 1 is a tandem-system digital color copying machine, forming a color image by sequentially superimposing toners of four colors, that is, yellow (Y), magenta (M), cyan (C), and black (K). Referring to FIG. 1, image forming apparatus 1 includes an image reading unit 10, a sheet feeding unit 20, an image forming unit 30, and a sheet storage unit 40.

Image reading unit 10 includes a loading tray 3 for setting a document, a platen glass 11, a feeding unit 2 for automatically feeding the document set on loading tray 3 to platen glass 11 one by one, and an ejection tray 4 for ejecting the read document. Further, image reading unit 10 includes a scanner not shown. The scanner is moved parallel to platen glass 11 by a scan motor. The scanner includes photoelectric conversion elements such as an exposure lamp applying light to the document, a reflecting mirror changing a direction of light reflected from the document, a mirror changing an optical path from the reflecting mirror, a lens collecting the reflected light, and a three-row (R, G, B) CCD (Charge Coupled Device) generating an electric signal according to the received reflected light.

The document fed by feeding unit 2 is set on platen glass 11, and is exposed and scanned when the scanner is moved parallel to platen glass 11. The light reflected from the document is converted into the electric signal by the photoelectric conversion elements, and input to image forming unit 30.

Image forming unit 30 is suspended by a plurality of rollers 32, 33, and 34 to prevent slacking. Image forming unit 30 includes an intermediate transfer belt 31, imaging units 21Y, 21M, 21C, and 21K (hereinafter collectively referred to as imaging units 21) corresponding to the toners of yellow (Y), magenta (M), cyan (C), and black (K) arranged along intermediate transfer belt 31 at a prescribed interval, developers included in respective imaging units 21, transfer rollers 25Y, 25M, 25C, and 25K (hereinafter collectively referred to as transfer rollers 25), a fixing device 36, and a controller unit 50 including a CPU (Central Processing Unit) and the like.

Intermediate transfer belt 31 is an endless belt rotated counterclockwise in FIG. 1 (i.e., in a direction indicated by an arrow A in FIG. 1) at a prescribed speed, by rotation of the plurality of rollers 32, 33, and 34 in the same direction. Transfer rollers 25Y, 25M, 25C, and 25K are paired with photoconductors included in the developers inside imaging units 21Y, 21M, 21C, and 21K, respectively, with intermediate transfer belt 31 being interposed therebetween. Fixing device 36 fixes the toner image transferred onto intermediate transfer belt 31 and thereafter transferred onto the sheet, on the sheet after the toner image is transferred onto the sheet.

Sheet storage unit 40 includes a paper cassette 41 accommodating sheets S serving as a printing medium. Sheet feeding unit 20 includes a plurality of rollers for feeding sheet S, such as a roller 42 for taking out sheet S from paper cassette 41, a roller 43 for regulating timing of feeding, a roller 35 for performing secondary transfer that will be described later, and a roller 37 for ejecting a printed sheet, and a sheet ejection tray 38 ejecting the printed sheet. A sheet detection unit 100 is provided on a feeding path along which sheet S is fed by the plurality of rollers described above. Preferably, sheet detection unit 100 is provided downstream of roller 43 in a direction in which sheet S is fed. Sheet detection unit 100 detects a sheet edge by a method that will be described later, and inputs a detection result to controller unit 50.

Controller unit 50 reads a program from a storage device such as a nonvolatile memory and executes the program based on an instruction signal input from an operation panel or the like not shown, and outputs control signals to the units described above, thus controlling the entire apparatus. Further, controller unit 50 may include therein time measurement means such as a timer, and execute the program when a prescribed time is measured. On that occasion, controller unit 50 uses the detection result input from sheet detection unit 100. Controller unit 50 may be provided in image reading unit 10, sheet feeding unit 20, or the like, other than image forming unit 30.

By executing the above program, controller unit 50 provides prescribed image processing in response to an image signal input from image reading unit 10 or an external apparatus, and produces color data converted into yellow, magenta, cyan, and black, which are digital signals for the respective colors. Image color data for cyan, image color data for magenta, image color data for yellow, and image color data for black for forming the image described above produced by controller unit 50 are output to exposure devices in imaging units 21 corresponding to the respective colors.

Each exposure device outputs a laser beam to the photoconductor based on the image data input from controller unit 50. Thereby, an evenly charged surface of the photoconductor is exposed according to the image data, and an electrostatic latent image is formed on the surface of the photoconductor. A developing bias voltage is applied to a developing roller. Thereby, a potential difference occurs between a potential of the developing roller and a potential of the latent image on the photoconductor. Charged toner is supplied to the photoconductor in that state, and thus a toner image is formed on the surface of the photoconductor. The toner image formed on the surface of the photoconductor is transferred onto intermediate transfer belt 31 serving as an image carrying body, by transfer roller 25 at a constant voltage or a constant current. This is referred to as primary transfer.

The toner image primarily transferred onto intermediate transfer belt 31 is transferred onto sheet S fed from paper cassette 41, by roller 34. This is referred to as secondary transfer. The toner image secondarily transferred onto the sheet is fixed on the sheet by fixing device 36, and ejected as an electrophotographic image on sheet ejection tray 38.

Figure 2:
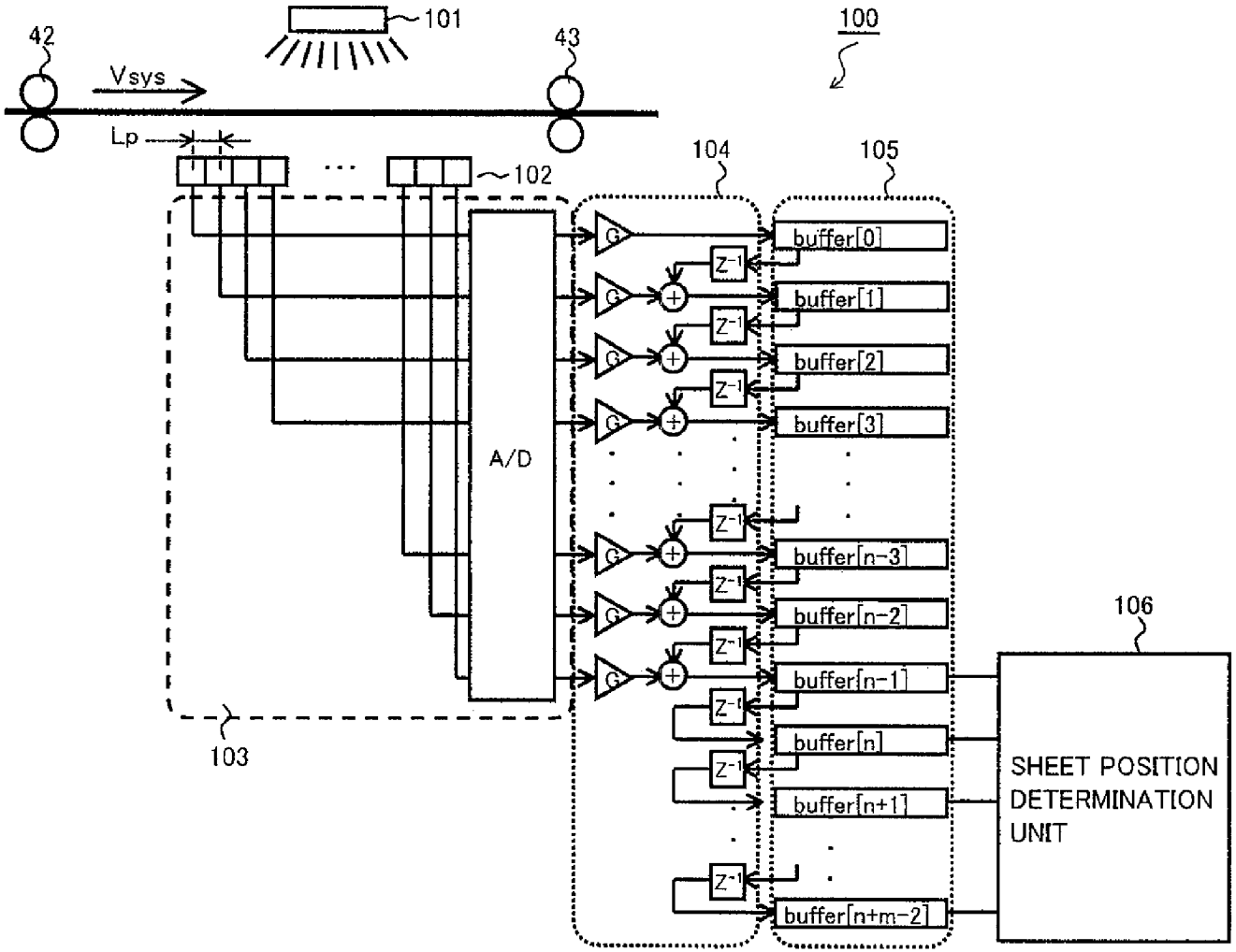
FIG. 2 is a view showing a concrete example of a configuration of a sheet detection unit in accordance with a first embodiment in the image forming apparatus.

Referring to FIG. 2, sheet detection unit 100 includes one or a plurality of light emitting units 101 and a light receiving unit 102 including n light receiving elements (n is two or more) provided with a sheet feeding path configured by rollers 42, 43, and the like being interposed therebetween.

The light receiving elements in number n is linearly arranged from an upstream side to a downstream side of the sheet feeding path, at a pitch Lp that is a sufficiently narrow interval. Examples of light receiving unit 102 include a CCD and a line sensor.

Light emitting unit 101 emits light according to the control signal from controller unit 50. The light receiving elements included in light receiving unit 102 each receive the light from light emitting unit 101 passing through the sheet feeding path. The n light receiving elements are each electrically connected to a capturing unit 103, and input a signal indicating the amount of received light to capturing unit 103.

Capturing unit 103 is electrically connected to a computation processing unit 104. Capturing unit 103 includes an A/D (analog to digital) converter. Capturing unit 103 converts the signal indicating the amount of received light input from each of the n light receiving elements into digital data, and inputs the digital data to computation processing unit 104 at each computation cycle T, according to the control signal from controller unit 50.

Computation processing unit 104 is electrically connected to a result storage unit 105. Result storage unit 105 includes (n+m−1) buffers, where m is any number not less than 1. Indexes assigned to the (n+m−1) buffers are indicated as 0 to (n+m−2), respectively. Buffer 0, which is the first buffer, is electrically connected to a first light receiving element of the n light receiving elements that is located on the most upstream side in the sheet feeding direction, with the A/D converter in capturing unit 103 and computation processing unit 104 being interposed therebetween. Similarly, buffer 1 to buffer (n−1) are also electrically connected to a second light receiving element to a n-th light receiving element, respectively. Among these buffers 0 to (n−1), buffer (n−1) to buffer (n+m−2) are each further electrically connected to a sheet position determination unit 106.

Computation processing unit 104 includes a gain circuit for adjusting a level of the signal input from capturing unit 103, a delay circuit for shifting data between the buffers with a delay of one computation cycle, and an adding circuit for adding the data shifted by the delay circuit to the signal adjusted by the gain circuit.

When computation processing unit 104 starts computation, it shifts data in buffer 0 to buffer (n−1) to adjacent buffers having greater indexes, respectively, by the delay circuits, and adds the shifted data to data input from capturing unit 103 to the buffers receiving the shifted data, by the adding circuits. Specifically, computation processing unit 104 shifts data in the buffers that are adjacent to the buffers connected to the second to the n-th light receiving elements and have smaller indexes, respectively, adds the shifted data to data corresponding to data from the second to the n-th light receiving elements among data input from capturing unit 103, respectively, sequentially from the downstream side in the sheet feeding direction, and stores the added data to the buffers connected to the second to the n-th light receiving elements, respectively. Data from the first light receiving element located on the most upstream side is not subjected to this addition processing, and is directly stored in buffer 0. It is to be noted that, prior to the computation, computation processing unit 104 may firstly collectively shift data to the adjacent buffers, and thereafter add, to respective data input from capturing unit 103, data already shifted to the buffers corresponding to the corresponding light receiving elements.

FIG. 2 shows an example in which computation processing unit 104 includes adding circuits. However, computation processing unit 104 may include subtracting circuits, and may shift data as previous computation results in the buffers to adjacent buffers having greater indexes, respectively, and thereafter subtract the shifted data from the respective data input from capturing unit 103, as in the above description.

As computation results when computation processing unit 104 includes the adding circuits as described above, a value of data buffer(p) in each of buffer 0 to buffer (n−1), with an index being indicated by a variable p, is represented by the following equation (1):

$$\text{buffer}(p) = \sum_{i=0}^{p} g(i)x(i)z^{-(p-i)}, \quad \text{equation (1)}$$

where x(i): signal data from each element, g(i): gain of each element, and $z^{-(p-i)}$: unit computation cycle×delay of (p-i).

The computation processing described above in computation processing unit 104 is performed at computation cycle T represented by the following equation (2):

$$T[s]=a*Lp/(b*V\text{sys}) \quad \text{equation (2)},$$

where a and b each represent an integer not less than 1, Lp [mm] represents a pitch of the light receiving elements, and Vsys [mm/sec] represents a sheet feeding speed.

Figure 3:
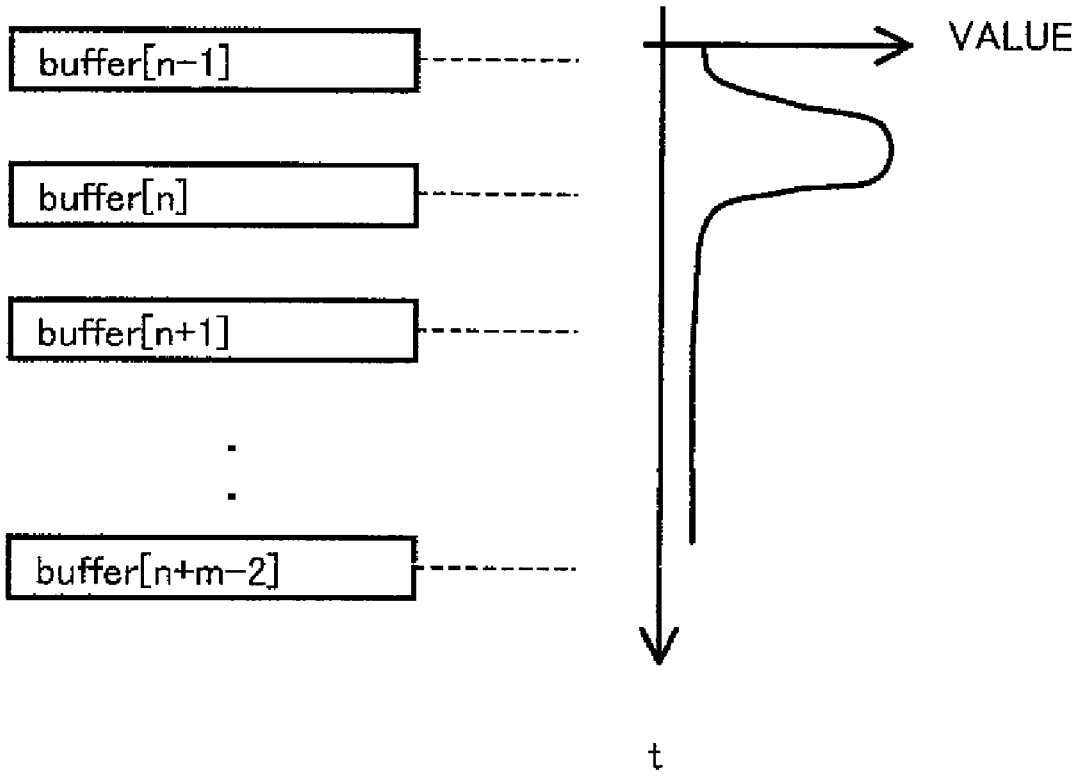
FIG. 3 is a view showing a concrete example of distribution of data stored in m continuous buffers included in the image forming apparatus in accordance with the embodiments.

Thereby, data indicating the amounts of light received by the light receiving elements among the light emitted from light emitting unit 101 are amplified with every lapse of the computation cycle that synchronizes with time in which a sheet is fed across pitch Lp between the light receiving elements, and stored in m buffers indicated as buffer (n−1) to buffer (n+m−2). FIG. 3 is a view showing a concrete example of distribution of the data stored in buffer (n−1) to buffer (n+m−2), in which at axis shown in a vertical direction represents the indexes of the buffers, and a value axis shown in a horizontal direction represents a magnitude of a value in each buffer.

Figure 4A:
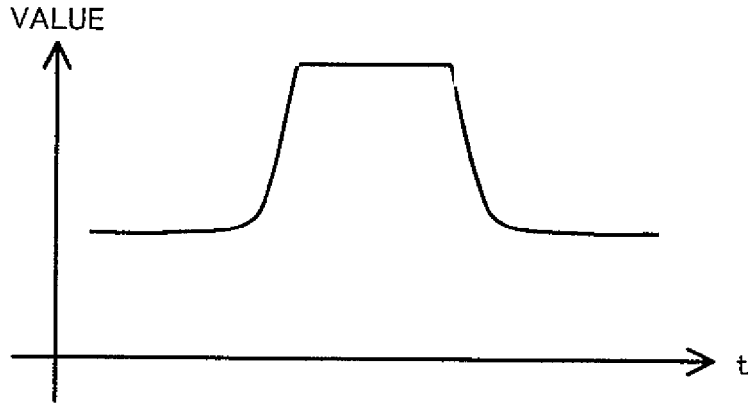
FIGS. 4A to 4C are views showing concrete examples of characteristic distributions of the distribution of data stored in the m continuous buffers, respectively.
Figure 4B:
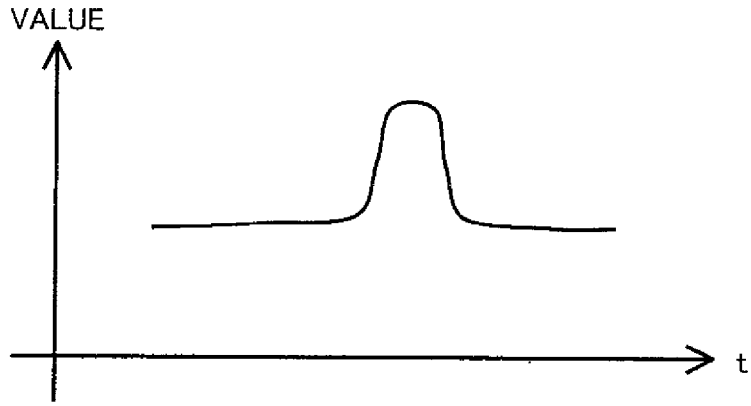
Figure 4C:
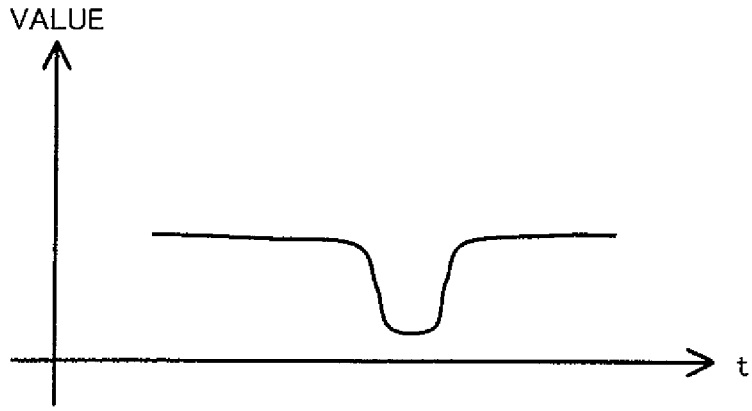

The distribution of the data stored in the m buffers indicated as buffer (n−1) to buffer (n+m−2) shows characteristic distributions as shown in FIGS. 4A to 4C, depending on sheet intervals. In FIGS. 4A to 4C, a horizontal axis t represents the indexes of the buffers, and a vertical axis represents a magnitude of a value in each buffer. FIG. 4A shows a concrete example of the distribution of the data stored in buffer (n−1) to buffer (n+m−2) in a case where a sheet interval, which is a distance between a trailing edge of a preceding sheet and a leading edge of a subsequent sheet, is sufficiently wide, FIG. 4B shows a concrete example thereof in a case where the sheet interval is narrow, and FIG. 4C shows a concrete example thereof in a case where the sheet interval is negative, that is, a preceding sheet overlaps with a subsequent sheet. It can be seen from FIGS. 4A to 4C that, in the case where the sheet interval is sufficiently wide, continuous buffers storing a peak level value exist in a large number to a certain extent (FIG. 4A), and when the sheet interval is narrow, the number of the continuous buffers storing a peak level value is smaller (FIG. 4B) when compared with the case where the sheet interval is sufficiently wide. When a preceding sheet overlaps with a subsequent sheet, there exist continuous buffers storing a value smaller than a base level value (i.e., an inverse peak level value) (FIG. 4C).

Figure 5:
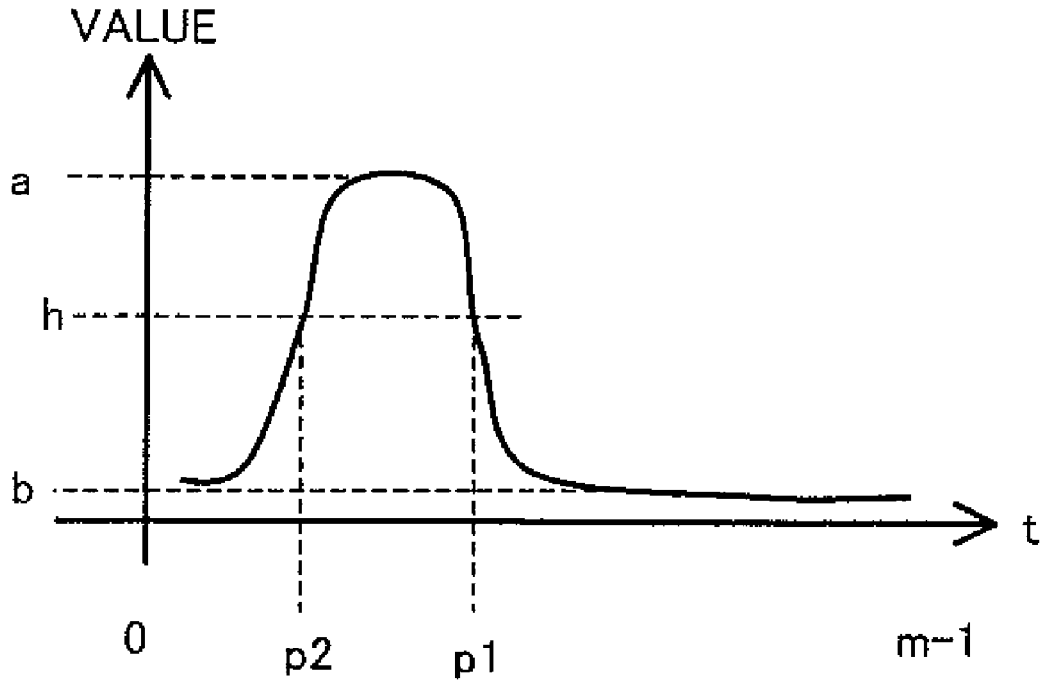
FIG. 5 is a view showing a concrete example of the distribution of data stored in the m continuous buffers.

Sheet position determination unit 106 calculates sheet interval positions, which are a trailing edge position Pr of a preceding sheet S1 and a leading edge position Pf of a subsequent sheet S2, with respect to a reference position P defined beforehand, based on the distribution of the data stored in the m buffers indicated as buffer (n−1) to buffer (n+m−2). Here, a description will be given on an assumption that the data stored in the m buffers indicated as buffer (n−1) to buffer (n+m−2) are distributed as shown concretely in FIG. 5. In FIG. 5, to provide a simpler description, the indexes are indicated as 0 to (m−1), which are obtained by uniformly subtracting (n−1) from the indexes of the buffers described above. These indexes will also be used in the description hereinafter. In FIG. 5, a value a represents a peak level of the data stored in the m buffers, a value b represents a base level of the data stored in the m buffers, and a value h represents an average value of peak level a and base level b. That is, values a, b, and h satisfy the following equation (3):

$$h=(a+b)/2 \quad \text{equation (3)}.$$

Sheet position determination unit 106 retrieves data most close to average value h from the values in the buffers showing the data distribution in FIG. 5, and reads indexes p1, p2 (p1>p2) of the buffers storing the data. Thereby, sheet position determination unit 106 calculates trailing edge position Pr of preceding sheet S1 and leading edge position Pf of a subsequent sheet S2, using the following equation (4) and equation (5), and inputs the sheet interval positions obtained as a result of the calculation to controller unit 50:

$$Pr=P+Lp*p1+V\text{sys}*Td \quad \text{equation (4)},$$

$$Pf=P+Lp*p2+V\text{sys}*Td \quad \text{equation (5)},$$

where Td [sec] represents delay time from when the data distribution is determined to when position calculation computation is completed.

FIG. 5 shows an example of data distribution when the sheet interval is very narrow as shown in FIG. 4B. The calculation method in sheet position determination unit 106 described using FIG. 5 is a method of calculating the sheet interval positions in the case where the sheet interval is sufficiently wide as shown in FIG. 4A, and in the case where the sheet interval is narrow as shown in FIG. 4B. However, even in the case where preceding sheet S1 overlaps with subsequent sheet S2 as shown in FIG. 4C, the sheet interval positions can be calculated by the same method as that described above using FIG. 5.

Figure 6:
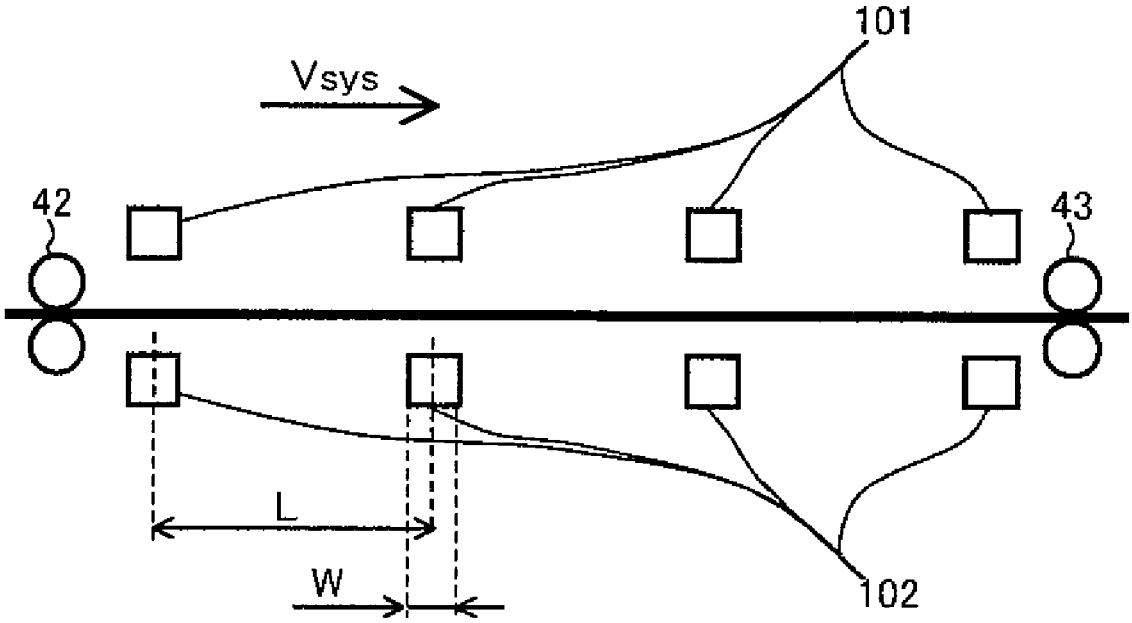
FIG. 6 is a view showing another concrete example of a configuration of a light emitting unit and a light receiving unit included in the sheet detection unit.

FIG. 6 shows another concrete example of a configuration of light emitting unit 101 and light receiving unit 102. Referring to FIG. 6, light emitting unit 101 includes a plurality of light emitting units, light receiving unit 102 includes a plurality of light receiving units, and one light emitting unit is paired with one light receiving unit with a feeding path being interposed therebetween. Pairs of a light emitting unit and a light receiving unit may be provided such that one pair and an adjacent pair have a sensor pitch L therebetween that is wider than pitch Lp of the light receiving elements such as a CCD and a line sensor and is wider than an opening width W of each light receiving unit. In this case, however, computation cycle T is sufficiently smaller than time in which a sheet passes across opening width W (=W/Vsys). Thereby, during when the sheet interval from the trailing edge of preceding sheet S1 to the leading edge of subsequent sheet S2 passes over opening width W of light receiving unit 102, there always occurs timing of reading, that is, computation, in light receiving unit 102, and a change in the amount of light caused by passing of the sheet interval is detected reliably by light receiving unit 102.

Although computation processing unit 104 has been described in the above description to perform the above computation by a hardware configuration including a circuit configuration, computation processing unit 104 may include a CPU, or at least a portion of computation may be performed by the CPU inside controller unit 50.

Processing for controlling sheet feeding performed by image forming apparatus 1 will be described using FIG. 7. The processing shown in a flowchart of FIG. 7 is implemented by the CPU included in controller unit 50 reading a program from a storage device such as a nonvolatile memory and executing the program to control the units shown in FIGS. 1 and 2.

Figure 7:
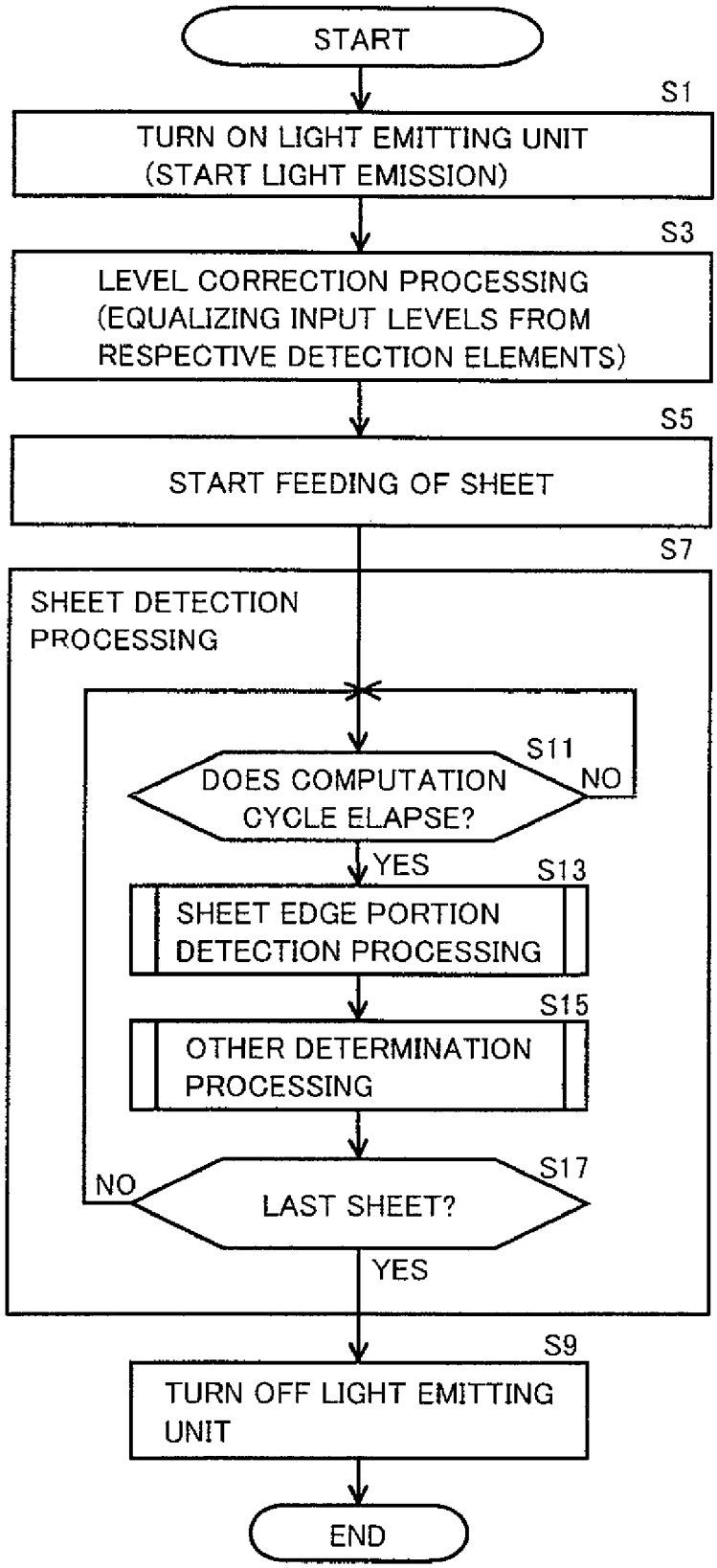
FIG. 7 is a flowchart showing a concrete example of a flow of processing for controlling sheet feeding performed in the image forming apparatus in accordance with the present embodiment.

Referring to FIG. 7, in step (hereinafter abbreviated as S) 1, the CPU included in controller unit 50 outputs a control signal instructing light emitting unit 101 to emit light, to sheet detection unit 100. Light emitting unit 101 starts light emission according to the control signal.

In S3, according to a control signal from the CPU, sheet detection unit 100 performs processing for equalizing input levels from the plurality of light receiving elements included in light receiving unit 102. Specifically, in S3, the CPU included in controller unit 50 performs processing for equalizing input levels from the plurality of light receiving elements, based on signals from the light receiving elements included in light receiving unit 102 in a state where no sheet is present between light emitting unit 101 and light receiving unit 102.

Thereafter, in S5, the rollers for feeding a sheet are operated according to a control signal from the CPU, and feeding of a sheet is started. When feeding of a sheet is started, the CPU outputs in S7, to sheet detection unit 100 and other detection units not shown, control signals for causing them to perform processing of detecting and determining information about the sheet being fed, and causes them to perform various types of detection processing. When sheet detection processing in S7 is terminated, the CPU outputs in S9 a control signal instructing light emitting unit 101 to terminate light emission, to sheet detection unit 100. Light emitting unit 101 terminates light emission according to the control signal.

In S7 described above, sheet detection unit 100 according to the control signal described above monitors a lapse of a computation cycle that will be described later. When a lapse of a computation cycle is detected (YES in S11), in S13, sheet detection unit 100 performs sheet edge portion detection processing, which is processing for detecting an edge portion of the sheet. Further, in S15, sheet detection unit 100 and/or the aforementioned other detection units not shown perform other detection and determination processing. In S7, sheet detection processing from S11 to S13 is repeated until when the last sheet is fed. When the last sheet is fed (YES in S17), the sheet detection processing in S7 is terminated.

Figure 8:
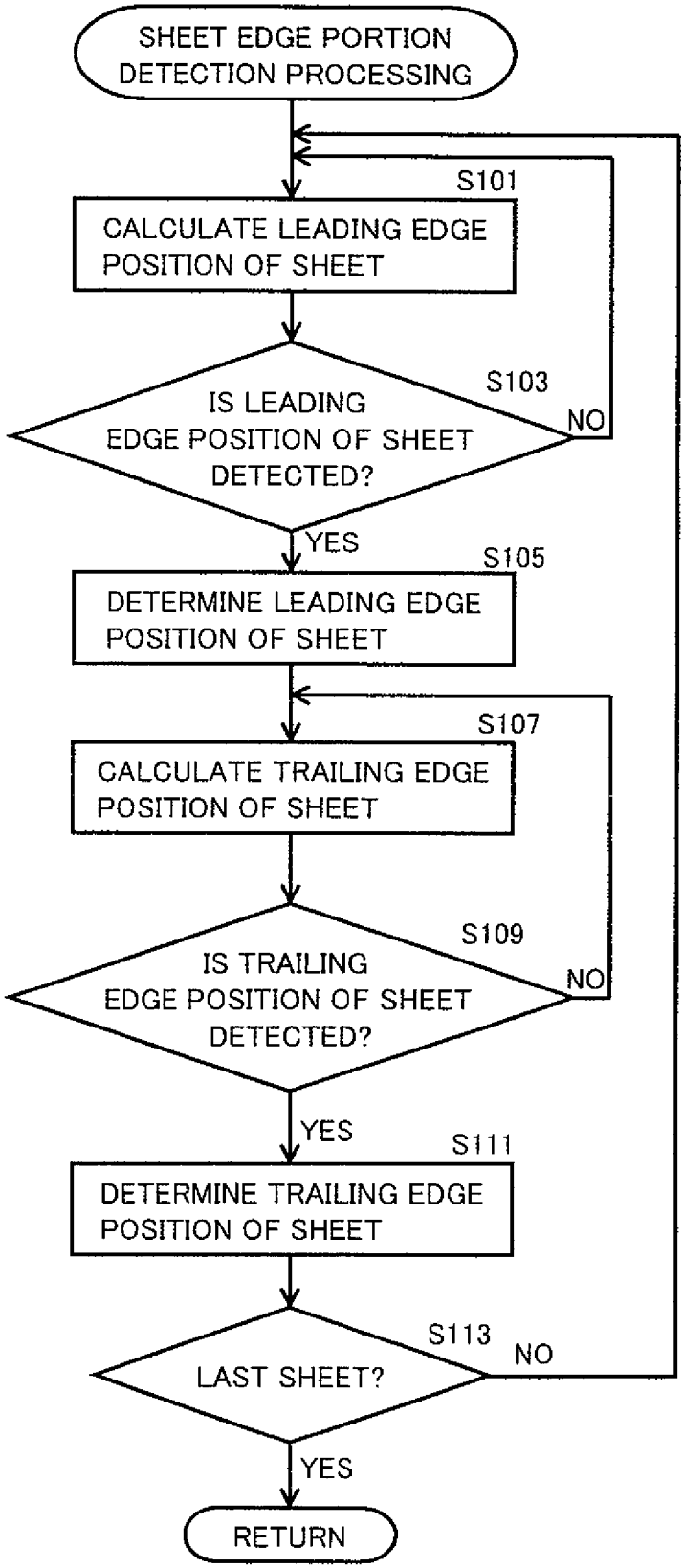
FIG. 8 is a flowchart showing a concrete flow of sheet edge portion detection processing in accordance with the first embodiment.

A concrete flow of the processing for detecting a sheet edge portion in S13 described above will be described using FIG. 8. Referring to FIG. 8, in S101, sheet position determination unit 106 in sheet detection unit 100 calculates leading edge position Pf of a sheet being fed firstly by substituting values stored in the m buffers indicated as buffer (n−1) to buffer (n+m−2) in result storage unit 105 into equation (5) described above, according to a control signal from the CPU. When leading edge position Pf of the first sheet is calculated in S101 (YES in S103), computation in S101 is terminated. Then, in S105, sheet detection unit 100 determines leading edge position Pf obtained in S101 as the leading edge position of the first sheet.

Subsequently, in S107, sheet position determination unit 106 in sheet detection unit 100 calculates trailing edge position Pr of the first sheet by substituting the values stored in the m buffers indicated as buffer (n−1) to buffer (n+m−2) in result storage unit 105 into equation (4) described above, according to a control signal from the CPU. When trailing edge position Pr of the first sheet is calculated in S107 (YES in S109), computation in S107 is terminated. Then, in S111, sheet detection unit 100 determines trailing edge position Pr obtained in S107 as the trailing edge position of the first sheet.

When the above processing is performed on respective sheets being fed, and the leading edge position and the trailing edge position of the last sheet are determined (YES in S113), a series of the sheet edge portion detection processing is terminated, and processing returns to 59.

At a time point when trailing edge position Pr of preceding sheet S1 and leading edge position Pf of subsequent sheet S2 are determined in the processing in S13, sheet position determination unit 106 determines positional relation between the trailing edge of sheet S1 and the leading edge of sheet S2. Specifically, sheet position determination unit 106 determines that these sheets have adequate positional relation when the interval therebetween is within a range defined beforehand, and determines that the interval between these sheets is too wide, or the interval is narrow, or these sheets overlap when the interval is outside the range described above. This determination may be performed by the CPU that receives calculation results of sheet edge positions.

The CPU can control sheet feeding at the time point when trailing edge position Pr of sheet S1 and leading edge position Pf of sheet S2 are determined, using this determination result. Specifically, when it is determined that the interval between the sheets is too wide, the CPU outputs a control signal to a mechanism driving the sheet feeding rollers such as rollers 42 and 43, to increase feeding speed Vsys or speed up timing of taking out a sheet from paper cassette 41. On the other hand, when it is determined that the interval between the sheets is narrow or the sheets overlap, the CPU outputs a control signal to the mechanism driving the sheet feeding rollers such as rollers 42 and 43, to decrease feeding speed Vsys or delay the timing of taking out a sheet from paper cassette 41.

Further, the CPU can control timing of image formation at the time point when the leading edge position of the sheet is determined. Specifically, the CPU outputs a control signal to image forming unit 30 to start printing at a position defined from the detected leading edge position.

Computation processing unit 104 performs the computation described above at the computation cycle that synchronizes with the time in which a sheet is fed across pitch Lp between the light receiving elements. Therefore, computation processing unit 104 adds data output by the light receiving elements receiving light at an interval between the sheets being fed, the number of times equal to the number n of the light receiving elements, along with movement of the sheet interval. That is, even when the amount of light received by light receiving elements is very small due to a reason such as a narrow sheet interval, data indicating the amount of light is added n times and amplified. Thereby, in the sheet edge portion detection processing in S13 described above, trailing edge position Pr and leading edge position Pf of sheets can be accurately detected even when the interval between the sheets being fed is very narrow or the sheets partially overlap. As a result, an image formation position on a sheet can be accurately controlled to be appropriate.

Second Embodiment

In the sheet feeding rollers such as rollers 42 and 43, a roller diameter is reduced or a friction coefficient on a roller surface is reduced due to the used amount or temporal change of image forming apparatus 1. A reduction in the roller diameter leads to a decrease in the feeding speed. A reduction in the friction coefficient on the roller surface causes a phenomenon that a sheet being fed slides (slips), leading to a decrease in the feeding speed. Therefore, due to such a temporal change, a difference may arise between an assumed sheet feeding speed and an actual sheet feeding speed. Further, due to manufacturing variations in the rollers, there may be a case where the actual sheet feeding speed is different from the assumed sheet feeding speed from an initial stage. In such a case, distribution of values in the buffers is displaced from the distributions shown in FIGS. 4A to 4C and FIG. 5.

Figure 9:
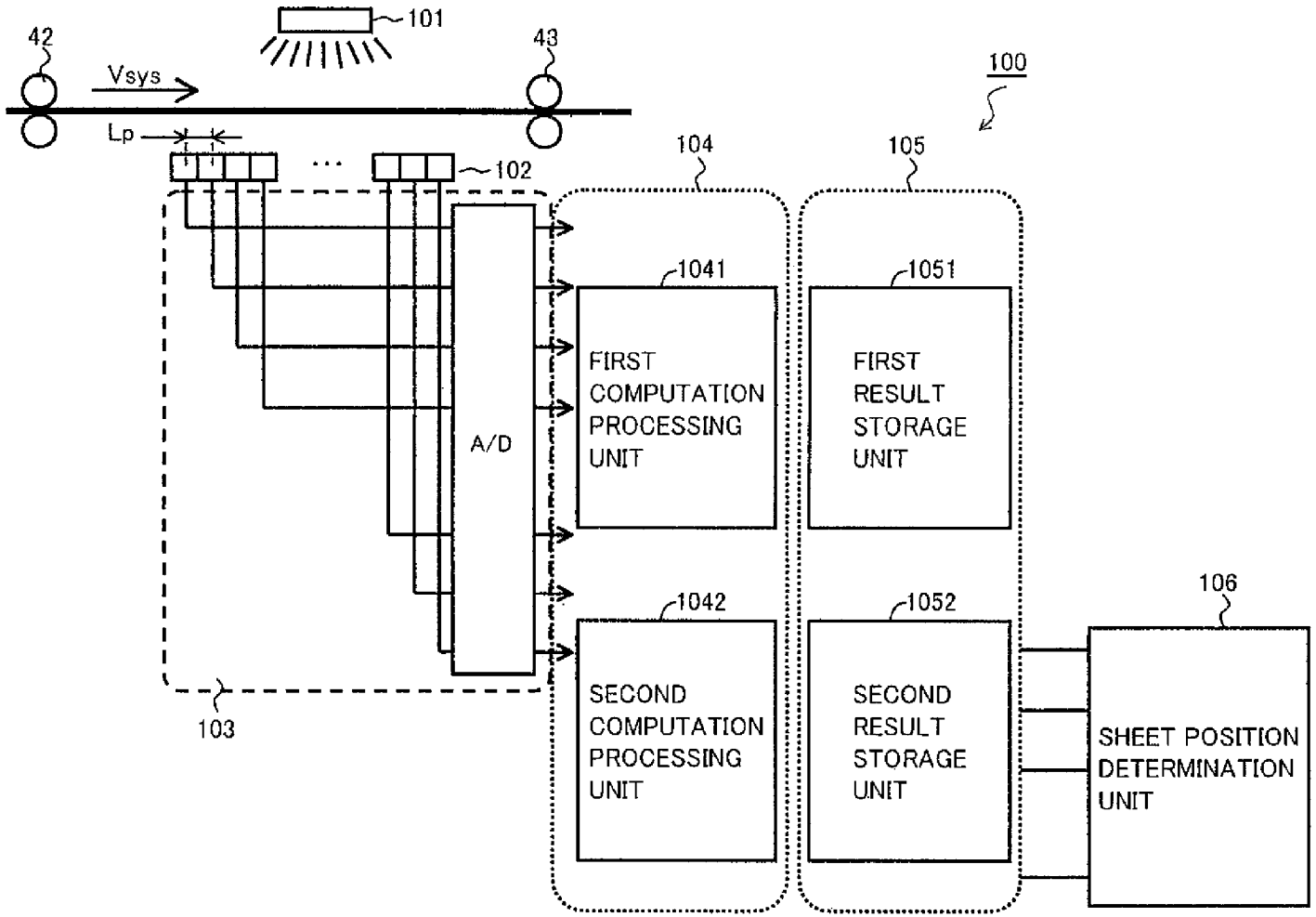
FIG. 9 is a view showing a concrete example of a configuration of a sheet detection unit in accordance with a second embodiment in the image forming apparatus.

Referring to FIG. 9, in a second embodiment, unlike the configuration of sheet detection unit 100 in accordance with the first embodiment shown in FIG. 2, computation processing unit 104 includes a first computation processing unit 1041 and a second computation processing unit 1042, and result storage unit 105 includes a first result storage unit 1051 and a second result storage unit 1052. They are the same in configuration as computation processing unit 104 and result storage unit 105 in accordance with the first embodiment described using FIG. 2.

In the second embodiment, the computation processing described above in the first computation processing unit 1041 is performed at a computation cycle T1 represented by the following equation:

$$T1[s]=a*Lp/(b*Vsys*\alpha 1/100).$$

Computation processing described below in the second computation processing unit 1042 is performed at a computation cycle T2 represented by the following equation:

$$T2[s]=a*Lp/(b*Vsys*\alpha 2/100),$$

where $\alpha$ represents an adjustment ratio of the computation cycle to an assumed value of the sheet feeding speed.

In the second embodiment, the first computation processing unit 1041 performs first computation processing at a computation cycle defined by an assumed speed Vs1, that is, computation cycle T1 described above, and the second computation processing unit 1042 performs second computation processing at a computation cycle defined by a second assumed speed Vs2 slightly different from assumed speed Vs1 described above, that is, computation cycle T2 described above. This is implemented by setting an adjustment ratio $\alpha$1 to 100% in the first computation processing unit 1041 and setting an adjustment ratio $\alpha$2 to 95%, with a speed reduction ratio of 5% being considered, in the second computation processing unit 1042.

Figure 10:
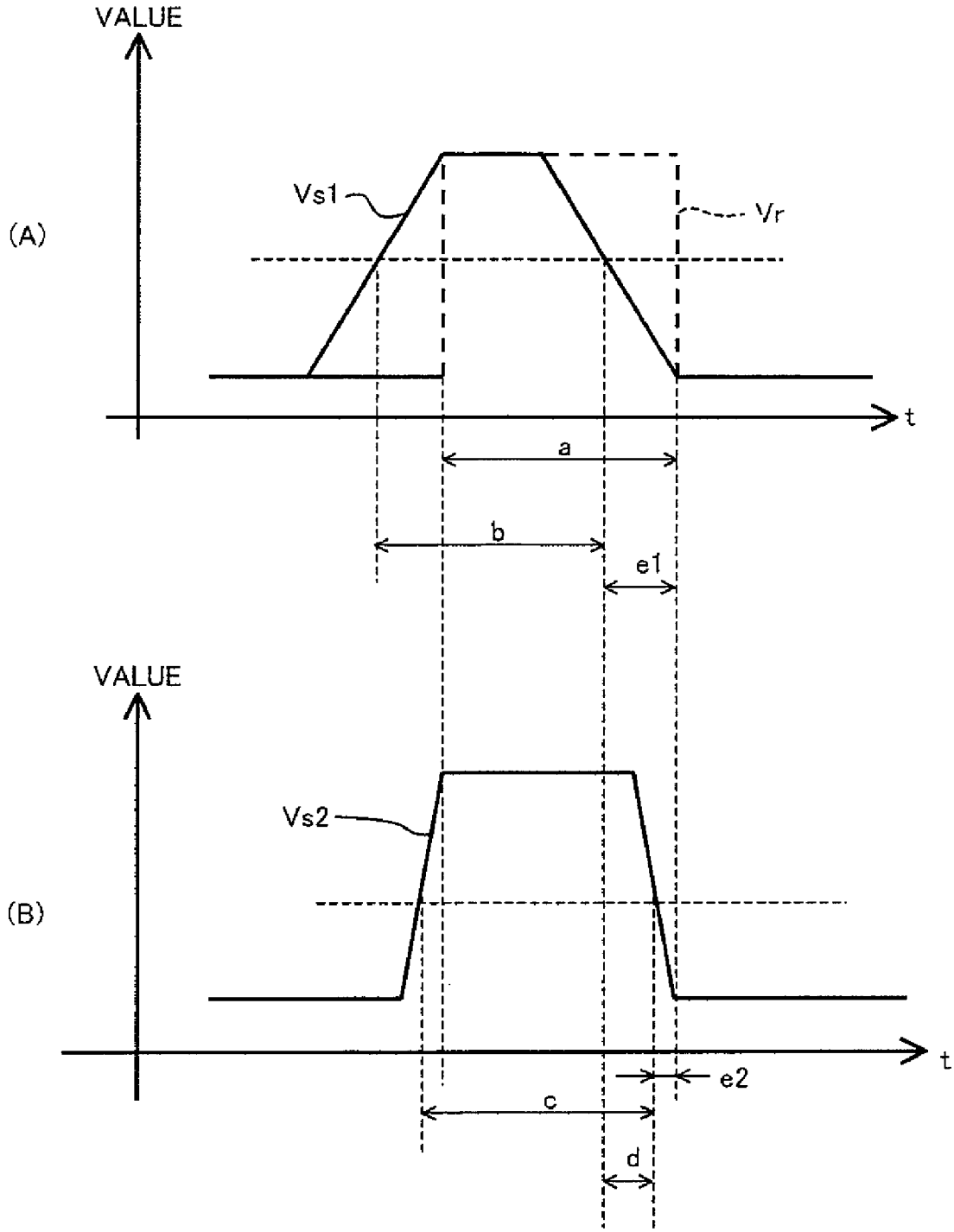
FIGS. 10 to 12 are views showing concrete examples of a method of computing the amount of displacement in distribution of data in buffers in the sheet detection unit in accordance with the second embodiment, respectively.

A concrete example of a method of calculating the amount of displacement described above in sheet detection unit 100 in accordance with the second embodiment will be described using FIG. 10, (A) of FIG. 10 is a view showing distribution of data in buffers in the first result storage unit 1051 in a case where an actual sheet feeding speed Vr is different from an assumed sheet feeding speed Vs1. In (A) of FIG. 10, a solid line represents distribution of data in the buffers in a case where actual speed Vr is slower than assumed speed Vs1, and a dot line represents distribution of data in the buffers in a case where actual speed Vr matches assumed speed Vs1. As shown in (A) of FIG. 10, a difference between indexes indicating an interval between two buffers storing an average value of stored values in the case where actual speed Vr matches speed Vs1 is represented as a, and a difference between indexes indicating an interval between two buffers storing the same value in the case where actual speed Vr is slower than speed Vs1 is represented as b. A difference between indexes indicating the amount of positional displacement between the buffers storing the value described above in the case where speed Vr matches the assumed speed and the buffers storing the value described above in the case where speed Vr is slower than speed Vs1 is represented as e1.

Referring to (A) of FIG. 10, even when actual feeding speed Vr is different from assumed feeding speed Vs1, range a and range b have substantially the same magnitude. However, since computation cycle T1 is defined by speed Vs1 (represented as speed Vsys in equation (2)), in the case where actual speed Vr is slower than assumed speed Vs1, the distribution of the data in the buffers has gentle slopes and is displaced toward the upstream side in the feeding direction by the amount of displacement e1, when compared to that in the case where actual speed Vr matches speed Vs1, as shown in (A) of FIG. 10. Therefore, when positions of sheet edge portions are calculated in sheet position determination unit 106 using equations (4) and (5) described above, calculation results of the positions of the sheet edge portions differ from actual positions due to the amount of displacement e1.

When a speed corresponding to a displacement (difference) between speed Vr and speed Vs1 is defined as a speed Ve1 (Ve1=Vr−Vs1), a time Ta1 taken to move a section with a sensor width La (La=Lp*n) at speed Ve1 is obtained by:

$$Ta1=La/Vs1.$$

The amount of positional displacement e1 between range a and range b shown in (A) of FIG. 10 corresponds to a distance for which a sheet is fed at speed Ve1 during time Ta1. Therefore, if actual speed Vr is already known, the amount of displacement e1 can be obtained by substituting speed Vr into the following equation (6). However, since actual speed Vr is unknown, the first computation processing unit 1041 cannot obtain the amount of displacement e1 even by using the following equation (6):

$$\begin{aligned} e1 &= Ve1*Ta1 \\ &= (Vr-Vs1)*La/Vs1 \\ &= (Vr-Vs1)/Vs1*Lp*n. \end{aligned} \quad \text{equation (6)}$$

(B) of FIG. 10 represents distribution of data in buffers in the second result storage unit 1052 in a case where actual speed Vr is slower than an assumed speed Vs2. As shown in (B) of FIG. 10, a difference between indexes indicating an interval between two buffers storing the average value of values stored in the buffers in the case where speed Vr matches assumed speed Vs1 in the case where speed Vr is slower than speed Vs2 is represented as c. A difference between indexes indicating the amount of positional displacement between the buffers storing the value described above in the case where speed Vr matches the assumed speed and the buffers storing the value described above in the case where speed Vr is slower than speed Vs2 is represented as e2.

When a speed corresponding to a displacement (difference) between speed Vr and speed Vs2 is defined as a speed Ve2 (Ve2=Vr−Vs2), a time Ta2 taken to move the section with sensor width La (La=Lp*n) at speed Ve2 is obtained by:

$$Ta2=La/Vs2.$$

The amount of positional displacement e2 between range a and range c shown in (B) of FIG. 10 corresponds to a distance for which a sheet is fed at speed Ve2 during time Ta2. Therefore, if actual speed Vr is already known, the amount of displacement e2 can be obtained by substituting speed Vr into the following equation (7). However, since actual speed Vr is unknown, the second computation processing unit 1042 cannot obtain the amount of displacement e2 even by using the following equation (7):

$$\begin{aligned} e2 &= Ve2*Ta2 \\ &= (Vr-Vs2)*La/Vs2 \\ &= (Vr-Vs2)/Vs2*Lp*n. \end{aligned} \quad \text{equation (7)}$$

Here, the computation processing in the first computation processing unit 1041 and the computation processing in the second computation processing unit 1042 are performed simultaneously. That is, two processing systems having different assumed speeds are simultaneously processed in sheet detection unit 100. Therefore, it is possible to temporally synchronize the computation processing in the first computation processing unit 1041 with the computation processing in the second computation processing unit 1042 as shown in (A) and (B) of FIG. 10. Sheet position determination unit 106 detects a difference d between the amount of displacement e1 and the amount of displacement e2 (d=e1−e2) from a computation result in the first computation processing unit 1041 and a computation result in the second computation processing unit 1042. Sheet position determination unit 106 indicates the amount of displacement e2 using the amount of displacement e1 as an unknown value and detected difference d (e2=e1−d), substitutes the amount of displacement e2 into equation (7) described above, solves equations (6) and (7) simultaneously, and thereby obtains actual speed Vr. Since speed Vr is determined, sheet position determination unit 106 calculates the amount of displacement e1 or the amount of displacement e2 from equations (6) and (7), and corrects a sheet edge portion detection position considering the amount of displacement e1 or the amount of displacement e2.

It is to be noted that, although the above description using FIG. 10 relates to a case where actual speed Vr is slower than any of assumed speeds Vs1 and Vs2, and assumed speed Vs2 is slower than assumed speed Vs1, that is, Vs1>Vs2>Vr, the amount of displacement e1 or the amount of displacement e2 can be calculated similarly in other cases where actual speed Vr is slower than assumed speed Vs1 and faster than speed Vs2, and assumed speed Vs2 is slower than assumed speed Vs1, that is, Vs1>Vr>Vs2 (first other case), and where actual speed Vr is faster than any of assumed speeds Vs1 and Vs2, and assumed speed Vs2 is slower than assumed speed Vs1, that is, Vr>Vs1>Vs2 (second other case). Specifically, (A) and (B) of FIG. 11 show distribution of data in the buffers in the first other case described above, and (A) and (B) of FIG. 12 show distribution of data in the buffers in the second other case described above.

Figure 11:
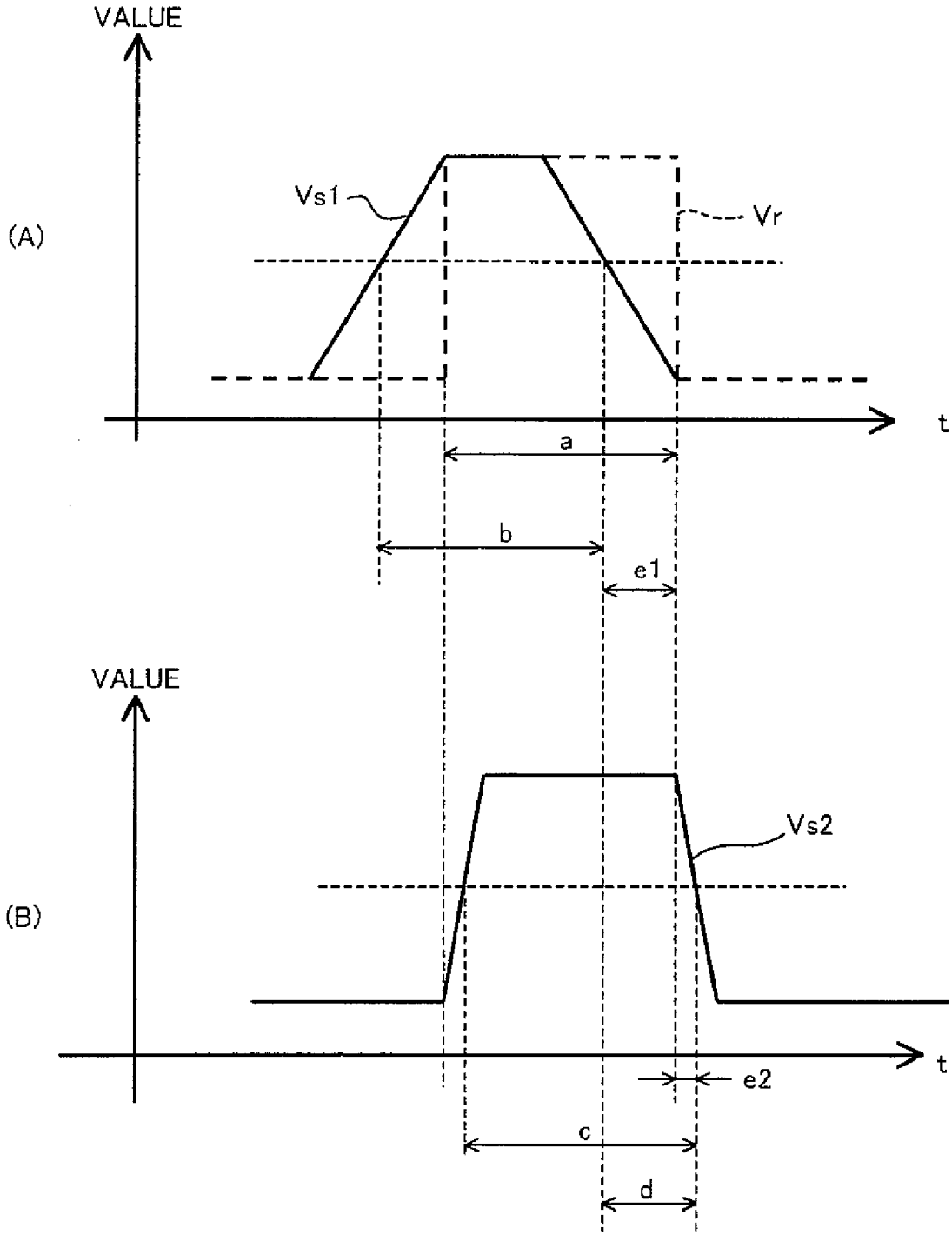

Referring to FIG. 11, in the first other case described above where actual speed Vr is faster than assumed speed Vs2, the distribution of data in the buffers is displaced toward the downstream side in the feeding direction by the amount of displacement e2, when compared with the case where actual speed Vr matches speed Vs2 ((B) of FIG. 11). Therefore, in the first other case described above, the amount of displacement e1 or the amount of displacement e2 can be calculated using the same method as the method described above, merely by inversing a sign of the amount of displacement e2.

Figure 12:
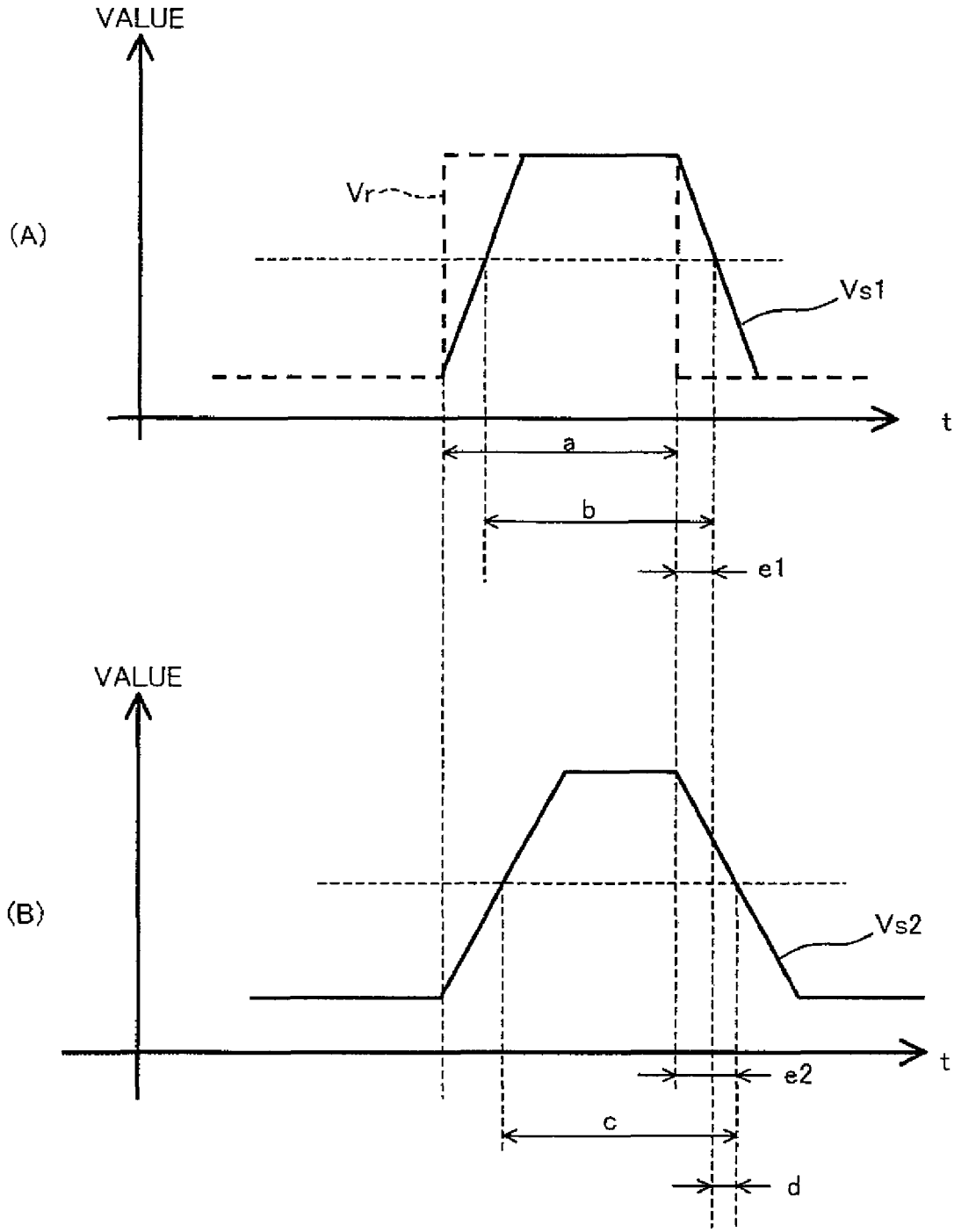

Similarly, referring to FIG. 12, in the second other case described above where actual speed Vr is faster than any of assumed speeds Vs1 and Vs2, the distribution of data in the buffers is displaced toward the downstream side in the feeding direction by the amount of displacement e1, when compared with the case where actual speed Vr matches speed Vs1 ((A) of FIG. 12), and the distribution of data in the buffers is displaced toward the downstream side in the feeding direction by the amount of displacement e2, when compared with the case where actual speed Vr matches speed Vs2 ((B) of FIG. 12). Therefore, in the second other case described above, the amount of displacement e1 or the amount of displacement e2 can be calculated using the same method as the method described above, merely by inversing signs of the amount of displacement e1 and the amount of displacement e2.

It is to be noted that, although FIG. 9 shows, as a configuration of sheet detection unit 100 in accordance with the second embodiment, a configuration in which the first computation processing unit 1041 and the second computation processing unit 1042 respectively perform computation processing on data captured by capturing unit 103, sheet detection unit 100 may have a configuration in which capturing unit 103 includes a plurality of capturing units corresponding to the first computation processing unit 1041 and the second computation processing unit 1042, respectively, and the respective capturing units capture signals from light receiving unit 102, as another configuration.

Third Embodiment

Figure 13A:
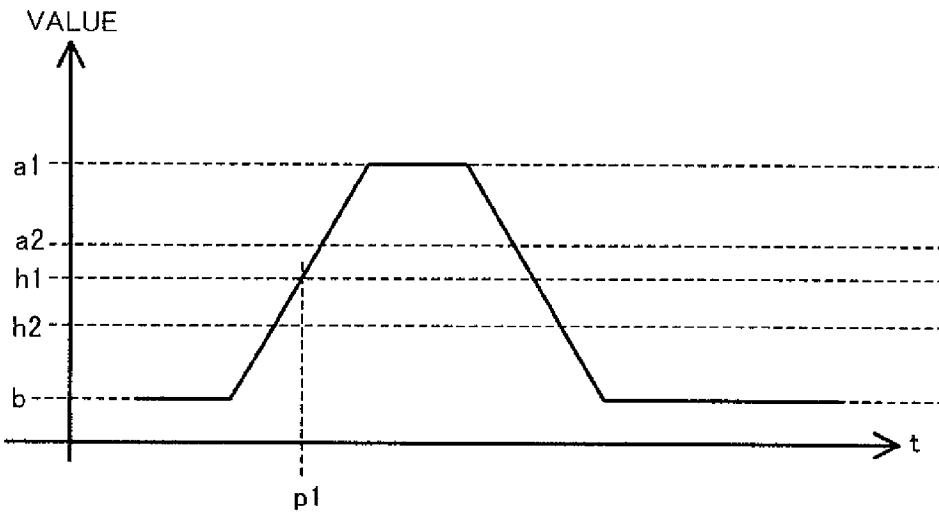
FIGS. 13A and 13B are views showing concrete examples of distribution of data in m continuous buffers.

FIG. 13A is a view showing a concrete example of distribution of data in the buffers in a case where the interval between sheets being fed is sufficiently wide although an actual feeding speed is different from an assumed speed. In this case, the distribution of data in the buffers has gentle slopes as described above. When a light receiving level a1 obtained when no sheet is being fed on light receiving unit 102, that is, a value obtained by performing a series of computation processing with no sheet being present on light receiving unit 102, is defined as a peak level, if the sheet interval is sufficiently wide, the data in the buffers reach light receiving level a1 as shown in FIG. 13A. Therefore, sheet position determination unit 106 can determine a sheet leading edge position by specifying buffer p1 on the upstream side of two buffers storing an average value h1 of light receiving level a1 as the peak level and base level b (h1(a1+b)/2), that is, by obtaining an intersection point p1 of h1 and the data distribution in FIG. 13A.

Figure 13B:
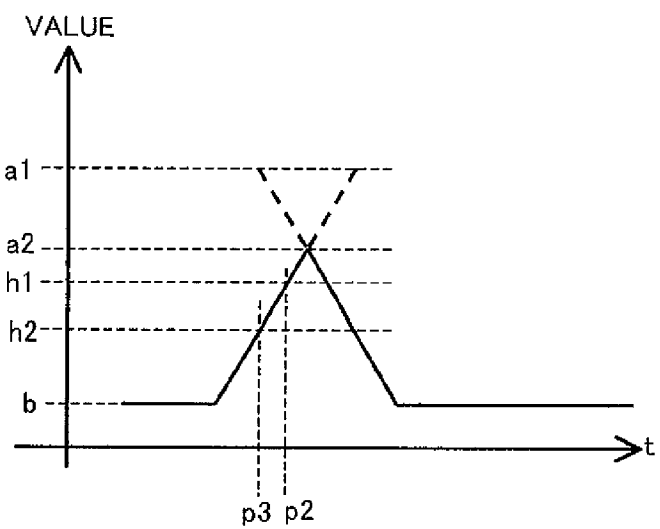

However, if the sheet interval is narrow as shown in FIG. 4B, the range of buffers storing the peak level value is narrow. In particular, when an actual feeding speed is different from an assumed speed, the data in the buffers may not reach the peak level as shown in FIG. 13B. In this case, if sheet position determination unit 106 similarly specifies a buffer p3 on the upstream side of two buffers storing an average value h2 of a maximum value a2 and a minimum value b of the data in the buffers (h2=(a2+b)/2), that is, obtains an intersection point p3 of h2 and the data distribution in FIG. 13B, sheet position determination unit 106 determines that a sheet leading edge position is a position corresponding to buffer p3. Thereby, there occurs an error between the determined sheet leading edge position and an actual position corresponding to buffer p2.

Accordingly, sheet detection unit 100 in accordance with a third embodiment performs correction described below. Specifically, computation processing unit 104 obtains light receiving level a1 as the peak level in advance before a sheet is fed, based on a signal from light receiving unit 102 with no sheet being present on light receiving unit 102, and stores light receiving level a1 in result storage unit 105. Sheet position determination unit 106 calculates average value h1 (h1=(a1+b)/2) using base level b obtained from the computation result in computation processing unit 104 and light receiving level a1 as the peak level stored in advance in result storage unit 105, and specifies buffer p2 storing average value h1 corresponding to a sheet leading edge position, that is, obtains an intersection point p2 of h1 and the data distribution in FIG. 13B.

Figure 14:
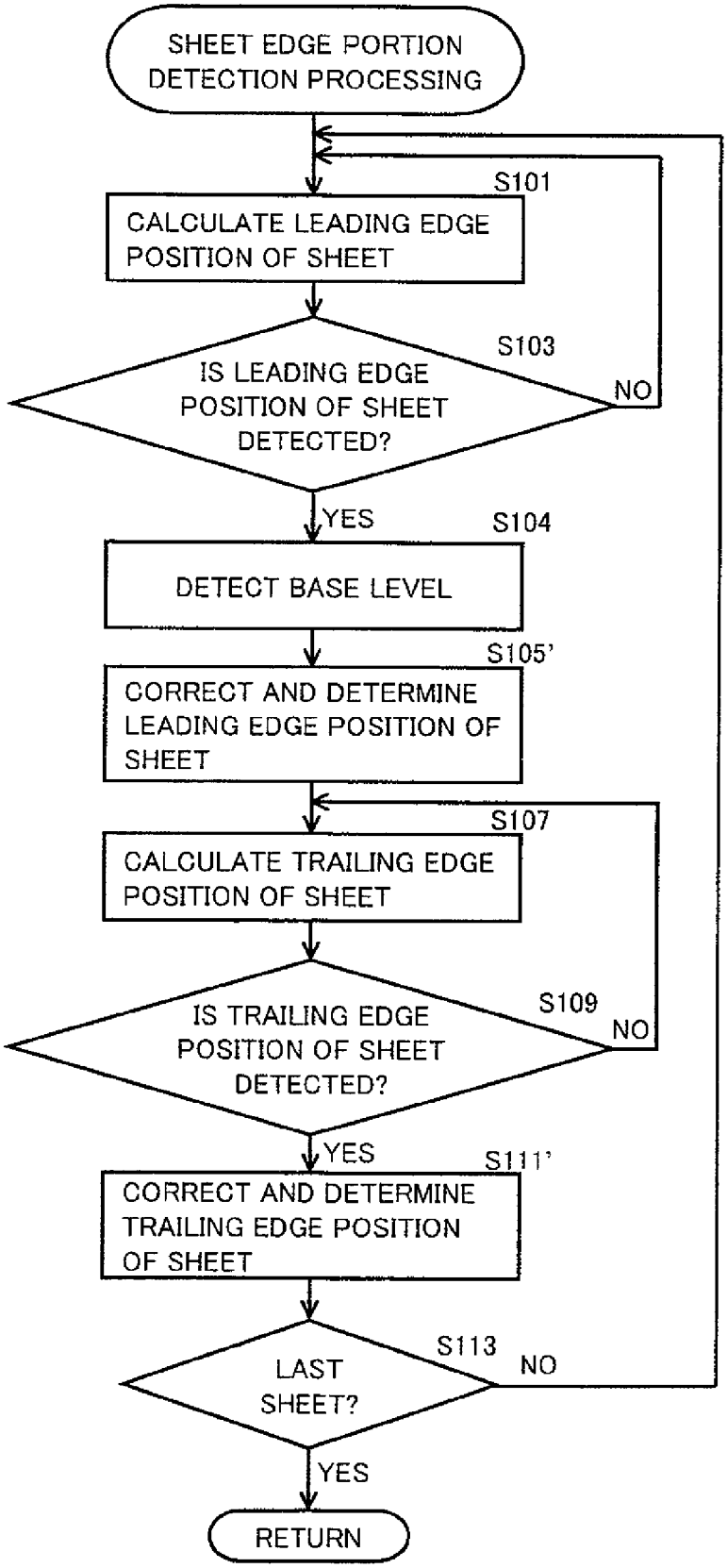
FIG. 14 is a flowchart showing a concrete flow of sheet edge portion detection processing in accordance with a third embodiment.

A concrete flow of the processing for detecting a sheet edge portion in S13 described above in this case will be described using FIG. 14. Referring to FIG. 14, when leading edge position Pf of the first sheet is calculated as in the processing shown in FIG. 8 in S101 (YES in S103), sheet detection unit 100 detects in S104 base level b in a state where a sheet is present on light receiving unit 102. In S105', sheet detection unit 100 corrects leading edge position Pf obtained in S101 as described above using base level b obtained in S104 and light receiving level a1 as the peak level stored in advance in result storage unit 105, and determines the corrected leading edge position as a leading edge position of the first sheet. Similarly, in S111', sheet detection unit 100 corrects trailing edge position Pr obtained in S107 as described above using base level b obtained in S104 and light receiving level a1 as the peak level stored in advance in result storage unit 105, and determines the corrected trailing edge position as a trailing edge position of the first sheet.

The correction described in the third embodiment and the correction described in the second embodiment may be combined. In that case, preferably, the correction described in the third embodiment is firstly performed in the sheet detection unit, and thereafter the correction described in the second embodiment is performed.

Fourth Embodiment

Examples of other detection and determination processing in S15 described above include processing for detecting skew of a sheet. As a fourth embodiment, a description will be given of a case where sheet detection unit 100 detects skew in S15 described above.

Figure 15:
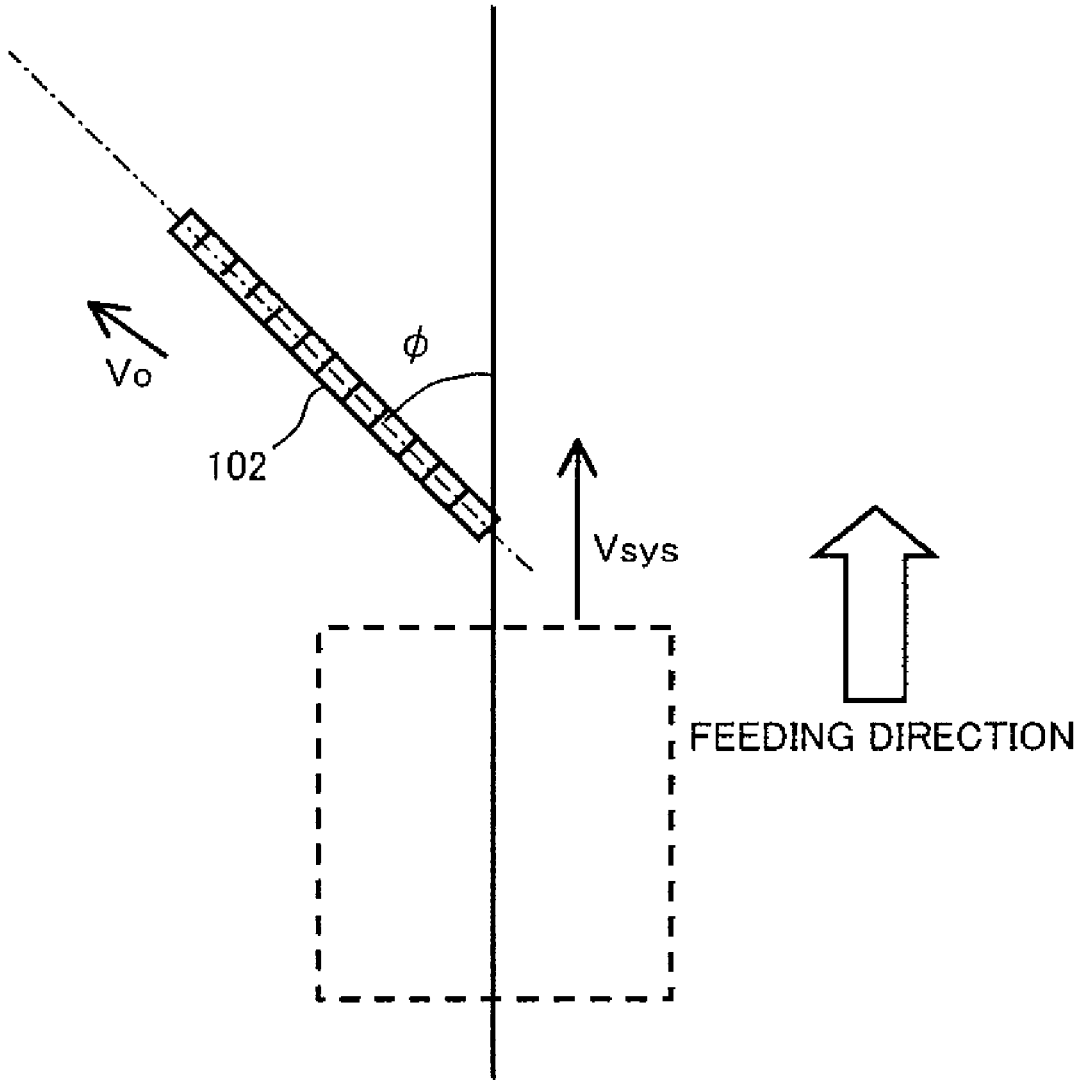
FIG. 15 is a view showing a concrete example of a configuration of a light receiving unit in a sheet detection unit in accordance with a fourth embodiment.

Referring to FIG. 15, in the fourth embodiment, the light receiving elements included in light receiving unit 102 are arranged in a plane parallel to a plane including a sheet being fed, in a direction at an angle $\phi$ with respect to a direction in which the sheet is fed. In this case, a speed component Vo in the direction in which the light receiving elements are arranged is represented by the following equation (8), using sheet feeding speed Vsys:

$$Vo = Vsys/\cos\phi \qquad \text{equation (8).}$$

Figure 16:
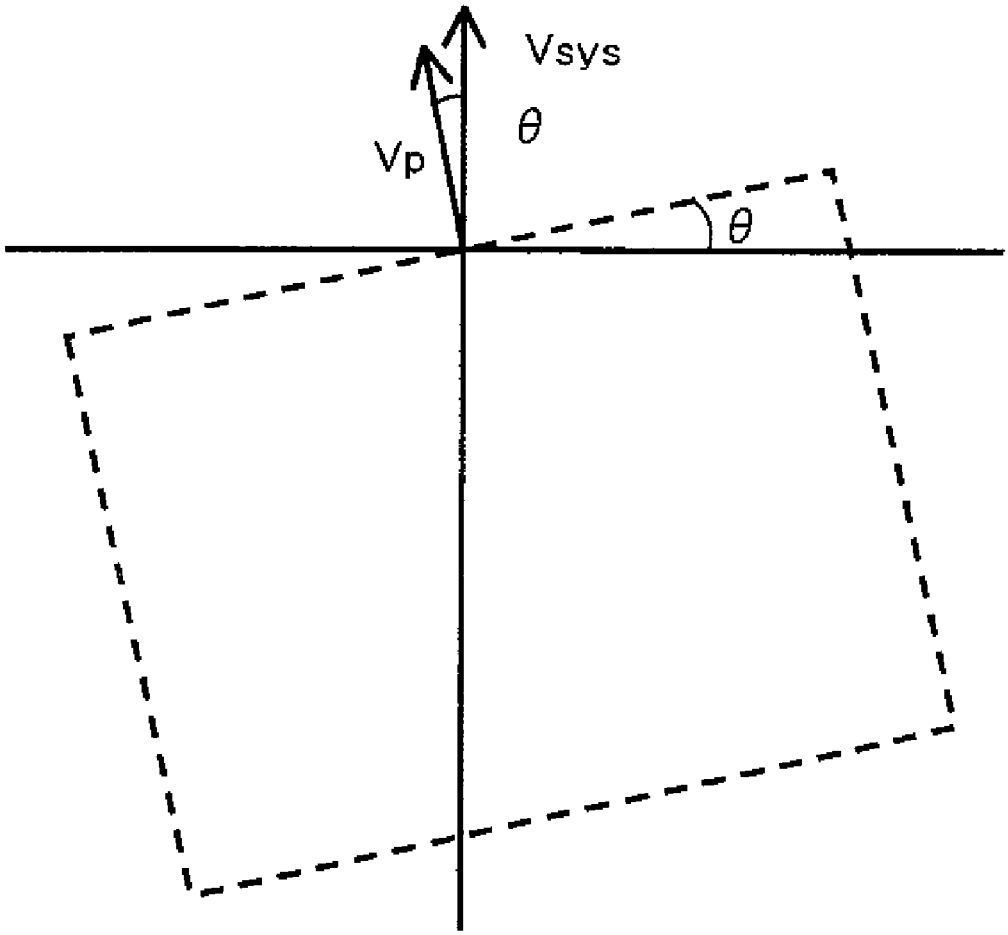
FIGS. 16 and 17 are views illustrating processing for detecting skew of a sheet being fed in the sheet detection unit in accordance with the fourth embodiment.

When a sheet is fed with being skewed at an angle $\theta$ with respect to the feeding direction as shown in FIG. 16, a speed component Vp in a front direction of the sheet being fed, that is, in a direction perpendicular to a side of the sheet having angle $\theta$ with respect to the feeding direction, is represented by the following equation (9):

$$Vp = Vsys \cdot \cos\theta \qquad \text{equation (9).}$$

Figure 17:
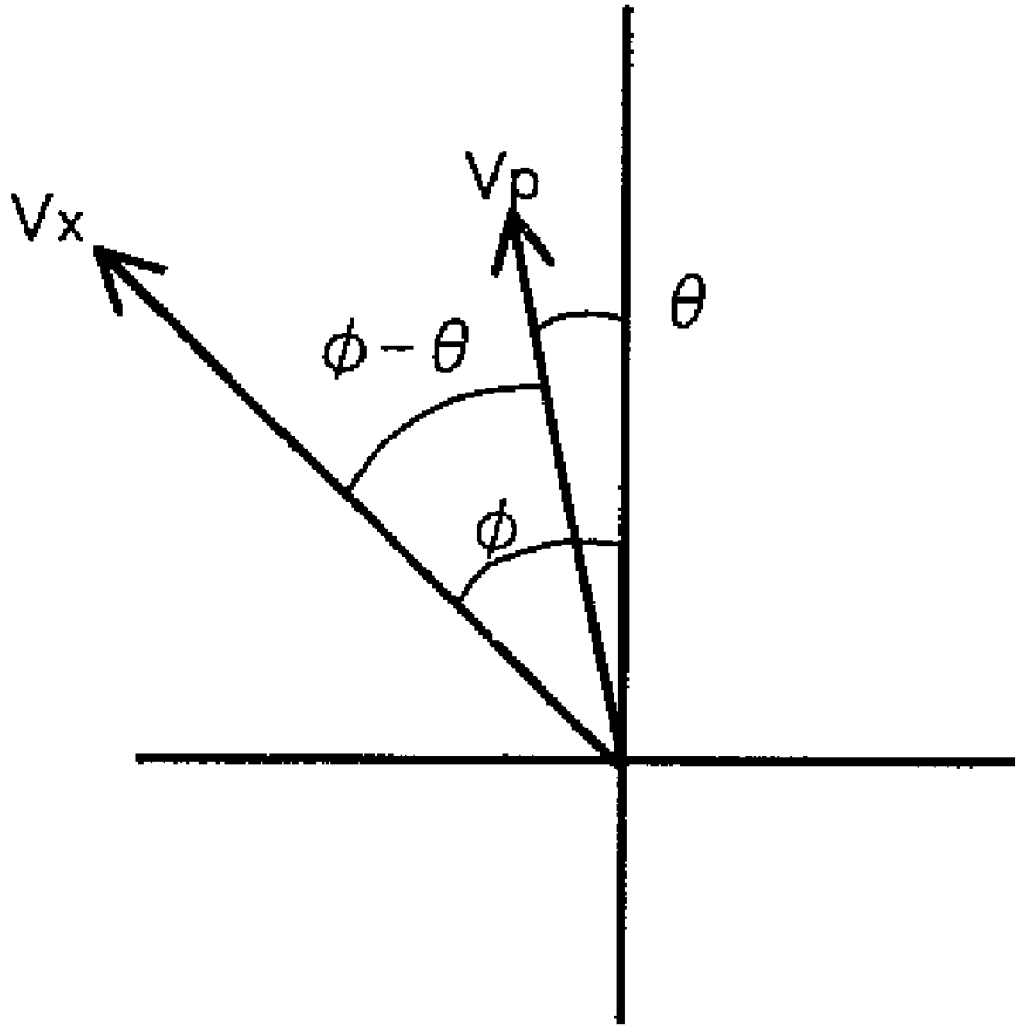
Figure 18:
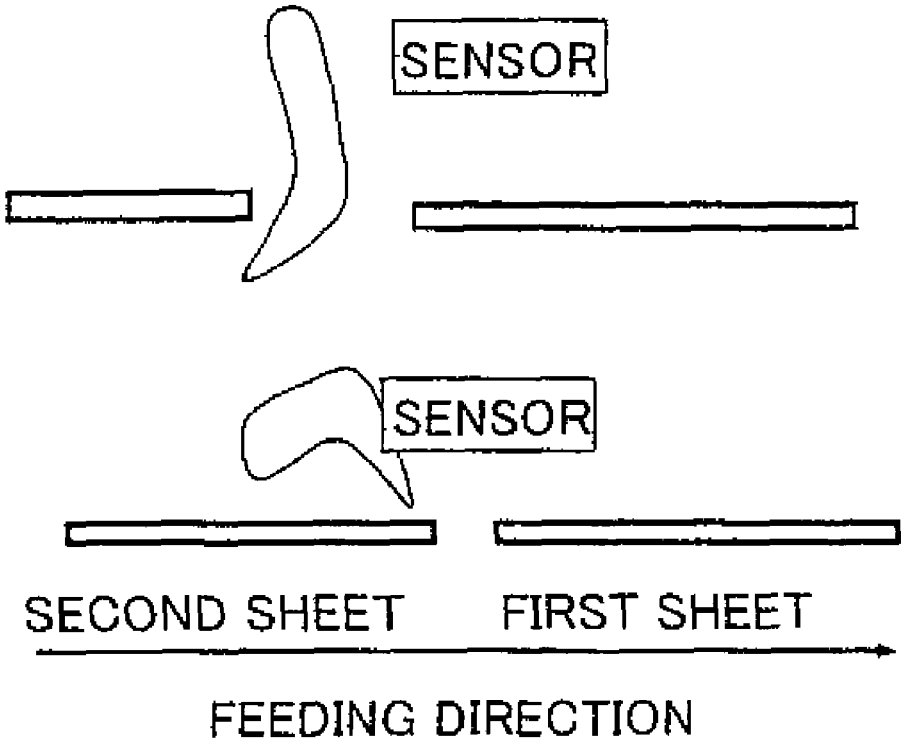
FIG.18 PRIOR ART
FIGS. 18, 19A, and 19B are views illustrating conventional techniques of detecting an edge portion of a sheet being fed.
Figure 19A:
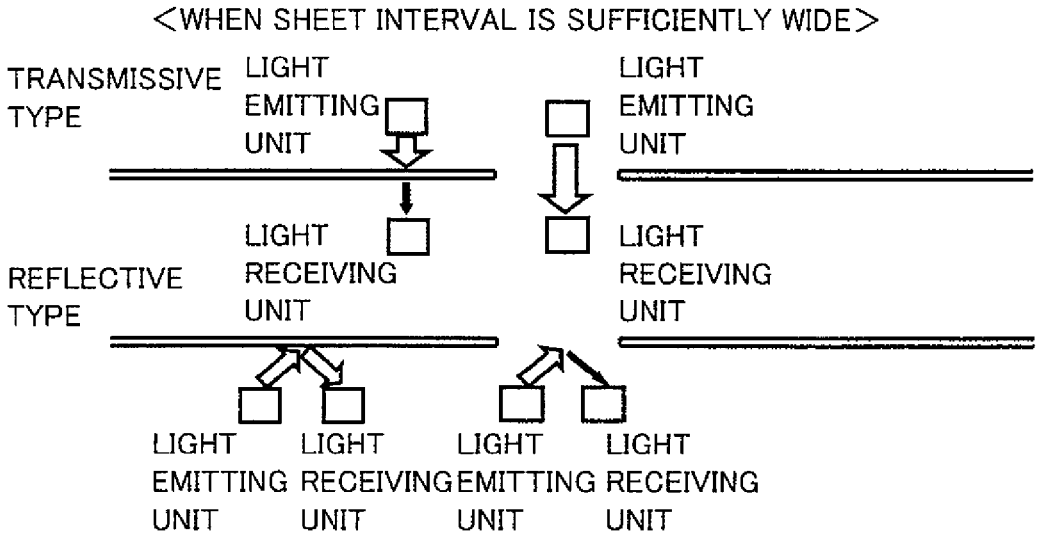
FIG.19A PRIOR ART
Figure 19B:
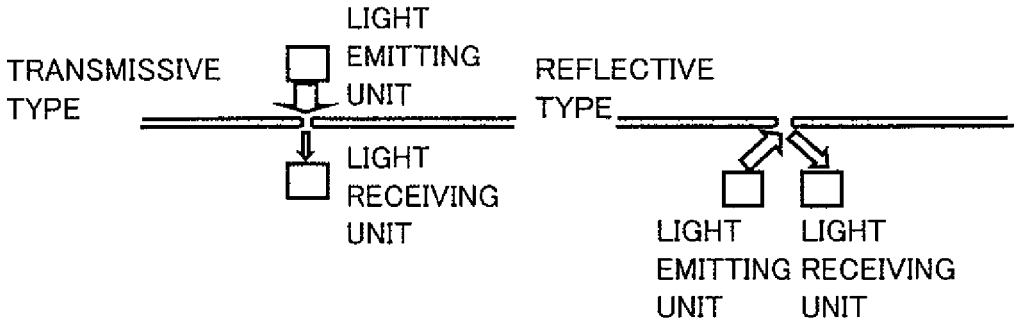
FIG.19B PRIOR ART

FIG. 17 shows relation among the direction in which the light receiving elements of light receiving unit 102 are arranged, skew of a sheet being fed, and the feeding direction. As shown in FIG. 17, a speed component Vx in the direction in which the light receiving elements are arranged, of speed component Vp in the front direction of the sheet being fed is represented by the following equation (10):

$$Vx = Vp/\cos(\phi-\theta) \qquad \text{equation (10).}$$

Based on equations (9) and (10), speed component Vx is represented by the following equation (11):

$$Vx = Vsys \cdot \cos\theta/\cos(\phi-\theta) \qquad \text{equation (11).}$$

Based on equations (8) and (11), speed component Vx is represented by the following equation (12):

$$Vx = Vo\cos\phi\cos\theta/\cos(\phi-\theta) \qquad \text{equation (12).}$$

When a sheet being fed has no skew with respect to the feeding direction ($\theta=0$), according to equation (12), speed component Vx in the direction in which the light receiving elements are arranged, of speed component Vp in the front direction of the sheet being fed is equal to speed component Vo in the direction in which the light receiving elements are arranged, of sheet feeding speed Vsys (Vx=Vo). Specifically, if a sheet is being fed with being skewed with respect to the feeding direction, an assumed speed Vo in the direction in which the light receiving elements are arranged, of an assumed speed Vsys of the sheet feeding speed differs from (a component in the direction in which the light receiving elements are arranged of) an actual sheet feeding speed Vx. Accordingly, sheet position determination unit 106 in accordance with the fourth embodiment can determine that the sheet being fed has an angle with respect to the feeding direction, that is, skewed with respect to the feeding direction, by determining that (the component in the direction in which the light receiving elements are arranged of) actual sheet feeding speed Vx is different from assumed speed Vo based on the observation that distribution of data in the buffers is the one shown in (A) of FIG. 10 or the like.

Further, when sheet detection unit 100 has a configuration identical to the configuration of FIG. 9 shown in the second embodiment, sheet detection unit 100 can calculate actual sheet feeding speed Vx using the same method as the method described using FIGS. 10 to 12. Furthermore, according to equation (12), sheet detection unit 100 can calculate skew angle $\theta$ from the following equation (13):

$$\tan\theta = (Vo-Vx)/Vx\tan\phi \qquad \text{equation (13).}$$

To calculate skew angle $\theta$ using equation (13) in sheet detection unit 100, angle $\phi$ between the direction in which the light receiving elements are arranged and the direction in which the sheet is fed is required to be an angle other than 0° and 90°. According to experiments conducted by the inventors, it has been verified that angle $\phi$ is preferably around 45°.

When a determination result that the sheet being fed is skewed with respect to the feeding direction is input from sheet position determination unit 106 to controller unit 50, or when calculated skew angle $\theta$ is input from sheet detection unit 100 to controller unit 50, the CPU outputs a control signal to the mechanism driving the sheet feeding rollers such as rollers 42 and 43 to eliminate the skew.

Further, a program for causing a computer to perform sheet detection processing such as the processing for detecting the position of a sheet edge and the processing for detecting skew of a sheet in image forming apparatus 1 described in the first embodiment to the fourth embodiment can also be provided. Such a program may be recorded in a non-transitory medium allowing the program to be read by a computer, and provided as a program product. Examples of such a "computer-readable recording medium" include a flexible disk, a CD-ROM (Compact Disk-Read Only Memory), a ROM (Read Only Memory), a RAM (Random Access Memory), a memory card, a hard disk built in a computer, and the like. Further, such a program may be provided by download through a network.

It is to be noted that the program as described above may invoke necessary modules among program modules provided as a portion of an operating system (OS) of a computer, in a prescribed arrangement and at prescribed timing, and cause the computer to perform the processing. In such a case, the program itself does not include the modules described above, and the processing is performed in cooperation with the OS. Such a program not including modules can also be included in the program as described above.

Further, the program as described above may be provided with being incorporated into a portion of another program. Also in that case, the program itself does not include modules included in the other program, and the processing is performed in cooperation with the other program. Such a program incorporated into another program can also be included in the program as described above.

The program product to be provided is installed in a program storage unit such as a hard disk and executed. The program product includes a program itself and a recording medium in which the program is recorded.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus, comprising:

a feeding mechanism for feeding a sheet on a feeding path at a prescribed feeding speed;

one or more light emitting sources for emitting light onto said feeding path;

a plurality of light receiving elements arranged on a side opposite to a side on which said light emitting source is provided, with said feeding path being interposed therebetween, linearly at a defined interval from an upstream side to a downstream side in a feeding direction in said feeding mechanism, and respectively outputting signals according to amounts of received light;

an information storage device including buffers respectively corresponding to said plurality of light receiving elements, and a buffer other than those; and a computation device for (i) performing computation on a plurality of data obtained from said signals respectively from said plurality of light receiving elements at a defined computation cycle, and obtaining computation results respectively corresponding to said plurality of data, (ii) storing said computation results in the buffers according to corresponding said light receiving elements, in said information storage device, and (iii) detecting a position of an edge portion of the sheet being fed on said feeding path based on a characteristic of a data series formed of entire said computation results by arranging said respective stored computation results according to an arrangement of corresponding said light receiving elements, wherein said computation is processing that shifts previous computation results respectively stored in said buffers to the buffers corresponding to the light receiving elements adjacent to corresponding said light receiving elements in said feeding direction in said arrangement, adds or subtracts the shifted computation results to or from the data obtained from said signals from said light receiving elements corresponding to the buffers receiving the shifted computation results, and thereby obtains new computation results, at each said computation cycle.

2. The image forming apparatus according to claim 1, wherein said computation cycle in said computation is time that is a multiple of a value obtained by dividing the interval between said light receiving elements in said feeding direction by said feeding speed.

3. The image forming apparatus according to claim 1, wherein said computation device synchronously performs plural types of said computation with different computation cycles, and further corrects the position of said detected edge portion by comparing said data series on computation results respectively obtained in the plural types of said computation.

4. The image forming apparatus according to claim 3, wherein said information storage device includes a set of the buffers respectively corresponding to said plurality of light receiving elements for storing the computation results respectively obtained in the plural types of said computation, in a number corresponding to the types of said computation.

5. The image forming apparatus according to claim 1, wherein said computation device further corrects levels of said signals from said plurality of light receiving elements to be uniform based on said signals from said light receiving elements in a state where no sheet is present between said light emitting source and said light receiving elements, or in a state where light emission from said light emitting source to all of said light receiving elements is blocked by the sheet.

6. The image forming apparatus according to claim 1, wherein said plurality of light receiving elements are arranged in a plane parallel to a plane including the sheet being fed on said feeding path, linearly at an angle other than 0° and 90° with respect to said feeding direction, and said computation device further performs skew detection processing for detecting that the sheet being fed on said feeding path has an angle with respect to said feeding direction, based on the characteristic of said data series.

7. A method for detecting an edge portion of a sheet being fed on a feeding path in an image forming apparatus, the method comprising the steps of:

providing an image forming apparatus including a feeding mechanism for feeding a sheet on a feeding path at a prescribed feeding speed, one or more light emitting sources for emitting light onto said feeding path;

a plurality of light receiving elements arranged on a side opposite to a side on which said light emitting source is provided, with said feeding path being interposed therebetween, linearly at a defined interval from an upstream side to a downstream side in a feeding direction in said feeding mechanism, and respectively outputting signals according to amounts of received light, and an information storage device including buffers respectively corresponding to said plurality of light receiving elements, and a buffer other than those;

performing computation of adding or subtracting, to or from a plurality of data obtained from said signals respectively from said plurality of light receiving elements, previous computation results respectively stored in the buffers corresponding to the light receiving elements adjacent to corresponding said light receiving elements in said feeding direction in an arrangement, and obtaining computation results respectively corresponding to said plurality of data, at each defined computation cycle;

storing said computation results in the buffers according to said corresponding light receiving elements; and detecting a position of the edge portion of the sheet being fed on said feeding path based on a characteristic of a data series formed of entire said computation results by arranging said respective stored computation results according to said arrangement of corresponding said light receiving elements.

8. The detection method according to claim 7, wherein said computation cycle is time that is a multiple of a value obtained by dividing the interval between said light receiving elements in said feeding direction by said feeding speed.

9. The detection method according to claim 7, wherein in the step of performing said computation and obtaining said computation results, plural types of said computations having different computation cycles are synchronously performed, and the detection method further comprises the step of correcting the position of said edge portion obtained in the step of detecting the position of said edge portion by comparing said data series on computation results respectively obtained in the plural types of said computations.

10. The detection method according to claim 9, wherein said information storage device of said image forming apparatus includes a set of the buffers respectively corresponding to said plurality of light receiving elements for storing the computation results respectively obtained in the plural types of said computations, in a number corresponding to the types of said computations.

11. The detection method according to claim 7, further comprising, prior to the step of performing said computation and obtaining said computation results, the step of correcting said signals from said plurality of light receiving elements to be uniform based on said signals from said light receiving elements in a state where no sheet is present between said light emitting source and said light receiving elements, or in a state where light emission from said light emitting source to all of said light receiving elements is blocked by the sheet.

12. The detection method according to claim 7, wherein said plurality of light receiving elements included in said image forming apparatus are arranged in a plane parallel to a plane including the sheet being fed on said feeding path, linearly at an angle other than 0° and 90° with respect to said feeding direction, and the detection method further comprises the step of detecting that the sheet being fed on said feeding path has an angle with respect to said feeding direction, based on the characteristic of said data series.

* * * * *